US007509073B2

(12) United States Patent
Katoh et al.

(10) Patent No.: US 7,509,073 B2
(45) Date of Patent: Mar. 24, 2009

(54) IMAGE FORMING APPARATUS AND BELT UNIT

(75) Inventors: Tsutomu Katoh, Kawasaki (JP); Mitsuru Takahashi, Kawasaki (JP); Kazuchika Saeki, Atsugi (JP); Kazuosa Kuma, Yokohama (JP); Takeshi Fukao, Yokohama (JP); Yoshiharu Kishi, Yokohama (JP)

(73) Assignee: Ricoh Co., Ltd., Tokyo (JP)

( * ) Notice: Subject to any disclaimer, the term of this patent is extended or adjusted under 35 U.S.C. 154(b) by 435 days.

(21) Appl. No.: 11/377,568

(22) Filed: Mar. 17, 2006

(65) Prior Publication Data

US 2006/0210307 A1 Sep. 21, 2006

(30) Foreign Application Priority Data

Mar. 17, 2005 (JP) ..... 2005-076423

(51) Int. Cl.
*G03G 15/08* (2006.01)

(52) U.S. Cl. ..... 399/121

(58) Field of Classification Search ..... 399/121, 399/302, 303, 308, 312, 313
See application file for complete search history.

(56) References Cited

U.S. PATENT DOCUMENTS 5,286,941 A 2/1994 Bel
5,442,428 A 8/1995 Takahashi et al.
5,612,771 A * 3/1997 Yamamoto et al. ..... 399/301
5,701,566 A 12/1997 Bisaiji et al.
5,870,650 A 2/1999 Takahashi et al.
5,950,062 A 9/1999 Yahata et al.
5,983,060 A 11/1999 Namekata et al.
6,006,062 A 12/1999 Takahashi et al.
6,035,157 A 3/2000 Takahashi et al.
6,115,568 A * 9/2000 Sameshima ..... 399/110
6,223,008 B1 4/2001 Takahashi et al.

(Continued)

FOREIGN PATENT DOCUMENTS

JP 08137296 A * 5/1996

(Continued)

OTHER PUBLICATIONS

U.S. Appl. No. 11/934,981, filed Nov. 5, 2007, Furuya et al.

(Continued)

*Primary Examiner*—Robert Beatty
(74) *Attorney, Agent, or Firm*—Oblon, Spivak, McClelland, Maier & Neustadt, P.C.

(57) ABSTRACT

An image forming apparatus includes an image forming mechanism for forming an image, at least one guide member arranged in parallel, and a belt unit to be inserted into and removed from the image forming apparatus. The belt unit includes a belt, at least two rotating supports, a supporting frame, a cover, and at least one guided member. The belt is formed in an endless belt shape and transfers the image formed by the image forming mechanism. The belt is looped over the rotating supports which are rotatably supported by the supporting frame. The cover covers an outer circumferential surface of the belt. The guided member is disposed on an outer surface of the cover, engages with the guide member, and is slidably moved along the guide member when the belt unit is inserted into and removed from the image forming apparatus.

17 Claims, 9 Drawing Sheets

U.S. PATENT DOCUMENTS

| | | | | |
|---|---|---|---|---|
| 6,269,228 | B1 | 7/2001 | Kayahara et al. | |
| 6,336,025 | B1 | 1/2002 | Saeki | |
| 6,445,900 | B2 | 9/2002 | Fukao et al. | |
| 6,505,024 | B2 | 1/2003 | Kayahara et al. | |
| RE38,206 | E | 7/2003 | Bisaiji et al. | |
| 6,611,672 | B2 | 8/2003 | Aoki et al. | |
| 6,618,565 | B2 | 9/2003 | Tamiya et al. | |
| 6,654,574 | B2 | 11/2003 | Kayahara et al. | |
| 6,690,905 | B2 | 2/2004 | Takahashi et al. | |
| 6,697,595 | B2 | 2/2004 | Kawagoe et al. | |
| 6,701,118 | B2 | 3/2004 | Kayahara et al. | |
| 6,741,821 | B2 | 5/2004 | Sugino et al. | |
| 6,785,500 | B2 | 8/2004 | Takahashi et al. | |
| 6,829,450 | B2 | 12/2004 | Tamiya et al. | |
| 6,868,248 | B2 | 3/2005 | Fukao et al. | |
| 6,898,407 | B2 | 5/2005 | Noguchi et al. | |
| 6,901,234 | B2 | 5/2005 | Ogiyama et al. | |
| 6,970,665 | B2 | 11/2005 | Kuma et al. | |
| 6,990,309 | B2 | 1/2006 | Kayahara et al. | |
| 6,996,354 | B2 * | 2/2006 | Kimura et al. | 399/121 |
| 7,187,887 | B2 * | 3/2007 | Inaba | 399/113 |
| 7,269,378 | B2 * | 9/2007 | Baek et al. | 399/121 |
| 7,382,999 | B2 * | 6/2008 | Takahashi | 399/110 |
| 2003/0118359 | A1 | 6/2003 | Ogiyama et al. | |
| 2004/0208676 | A1 | 10/2004 | Ishii et al. | |
| 2005/0008393 | A1 | 1/2005 | Kuma et al. | |
| 2005/0047816 | A1 | 3/2005 | Uchida et al. | |
| 2005/0084293 | A1 | 4/2005 | Fukuchi et al. | |
| 2005/0169653 | A1 | 8/2005 | Noguchi et al. | |
| 2005/0169667 | A1 | 8/2005 | Katoh | |
| 2005/0226657 | A1 | 10/2005 | Kuma et al. | |
| 2006/0210307 | A1 | 9/2006 | Katoh et al. | |

FOREIGN PATENT DOCUMENTS

| | | | | |
|---|---|---|---|---|
| JP | 09-244329 | | | 9/1997 |
| JP | 09-292812 | | | 11/1997 |
| JP | 2000172092 | A | * | 6/2000 |
| JP | 2000-206855 | | | 7/2000 |
| JP | 2000231271 | A | * | 8/2000 |
| JP | 2002108172 | A | * | 4/2002 |
| JP | 2004-318003 | | | 11/2004 |

OTHER PUBLICATIONS

U.S. Appl. No. 11/943,941, filed Nov. 21, 2007, Katoh et al.
U.S. Appl. No. 11/608,008, filed Dec. 7, 2006, Katoh et al.
U.S. Appl. No. 11/608,175, filed Dec. 7, 2006, Kuma et al.
U.S. Appl. No. 11/739,391, filed Apr. 24, 2007, Yokokawa et al.

* cited by examiner

IMAGE FORMING APPARATUS AND BELT UNIT

CROSS-REFERENCE TO RELATED APPLICATION

The present application is based on and claims priority to Japanese patent application No. 2005-076423 filed on Mar. 17, 2005 in the Japan Patent Office, the entire contents of which are hereby incorporated herein by reference.

BACKGROUND OF THE INVENTION

1. Field of the Invention

The present invention relates to an image forming apparatus and a belt unit, and more particularly to an image forming apparatus and a belt unit attachable to and detachable from the image forming apparatus.

2. Description of the Background Art

A background image forming apparatus, such as a copying machine, a printer, or a facsimile machine, generally includes a plurality of photoconductors to form a color image on a recording sheet. The photoconductors respectively carry toner images in yellow, magenta, cyan, and black colors which are formed with yellow, magenta, cyan, and black toner according to image data. The toner images formed on the photoconductors are superimposed and transferred onto an intermediate transfer belt to form a color toner image on the intermediate transfer belt. The color toner image formed on the intermediate transfer belt is further transferred onto a recording sheet to form a color image on the recording sheet.

The intermediate transfer belt is included in an intermediate transfer unit which is attachable to and detachable from the image forming apparatus. To insert the intermediate transfer unit into the image forming apparatus, an operator of the image forming apparatus holds guided members disposed on the intermediate transfer unit and engages the guided members with guide members disposed in the image forming apparatus. The operator then pushes the intermediate transfer unit into the image forming apparatus in a horizontal direction. Thus, the guide members guide the intermediate transfer unit into the image forming apparatus via the guided members.

The intermediate transfer belt is looped over a plurality of rollers of which shafts are supported by two opposed frame brackets. The guided members are disposed along outer surfaces of those two opposed frame brackets so as to be extended in a direction perpendicular to a lengthwise direction of the roller shafts. Therefore, the intermediate transfer unit may be inserted into and removed from the image forming apparatus only in a direction perpendicular to the lengthwise direction of the roller shafts.

SUMMARY OF THE INVENTION

This specification describes a novel image forming apparatus. In one aspect of the present invention, the novel image forming apparatus includes an image forming mechanism configured to form an image, at least one guide member arranged in parallel, and a belt unit configured to be inserted into and removed from the image forming apparatus along a lengthwise direction of the at least one guide member. The belt unit includes a belt, at least two rotating supports, a supporting frame, a cover, and at least one guided member. The belt is formed in an endless belt shape and is configured to transfer the image formed by the image forming mechanism. The belt is looped over the at least two rotating supports. The supporting frame is configured to rotatably support the at least two rotating supports. The cover is configured to cover an outer circumferential surface of the belt. The at least one guided member is disposed at positions in parallel on an outer surface of the cover and is configured to engage with the at least one guide member and to be slidably moved along the at least one guide member when the belt unit is inserted into and removed from the image forming apparatus.

This specification further describes a novel belt unit. In one aspect of the present invention, the novel belt unit is inserted into and removed from an image forming apparatus and includes a belt, at least two rotating supports, a supporting frame, a cover, and at least one guided member. The belt is formed in an endless belt shape and is looped over the at least two rotating supports. The supporting frame is configured to rotatably support the at least two rotating supports. The cover is configured to cover an outer circumferential surface of the belt. The at least one guided member is disposed at positions in parallel on an outer surface of the cover and is configured to engage with at least one guide member provided in the image forming apparatus and to be slidably moved along the at least one guide member when the belt unit is inserted into and removed from the image forming apparatus.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
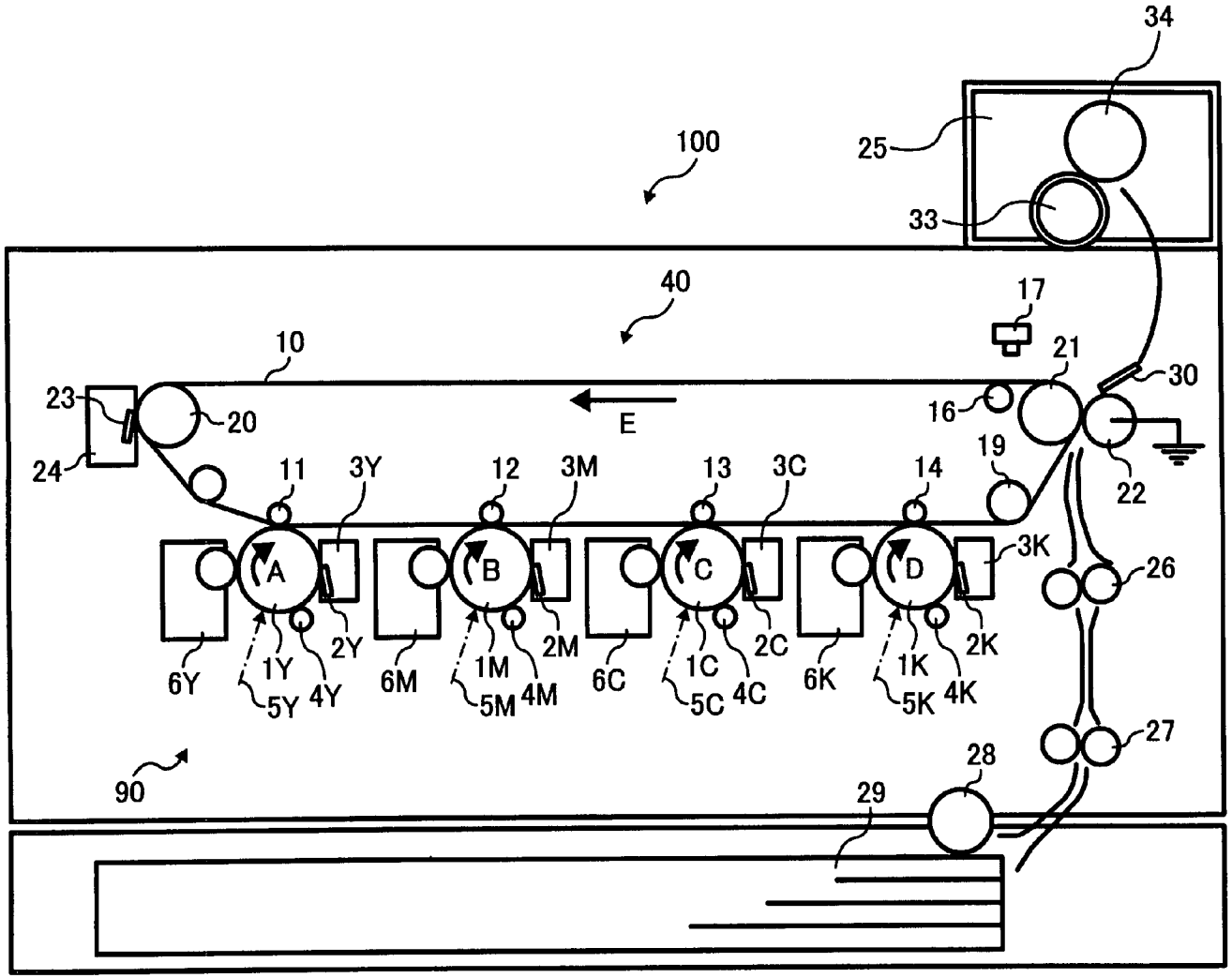
FIG. 1 is a schematic view of an image forming apparatus according to an exemplary embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIG. 1, an image forming apparatus 100 according to an exemplary embodiment of the present invention is explained.

As illustrated in FIG. 1, the image forming apparatus 100 includes an image forming unit 90, a transfer belt unit 40 including an intermediate transfer belt 10, first transfer bias rollers 11, 12, 13, and 14, a second transfer entrance roller 19, a second transfer bias roller 21, a sensor roller 16, and a belt cleaning roller 20, a pick-up roller 28, a feeding roller 27, a registration roller 26, a second transfer roller 22, a separator 30, a sensor 17, a belt cleaning unit 24 including a belt cleaning blade 23, and a fixing unit 25 including rollers 33 and 34.

The image forming apparatus 100 forms an image according to an electrophotographic method. According to this non-limiting embodiment, the image forming apparatus 100 functions as a tandem type printer which includes four photoconductors as latent image carriers for carrying an electrostatic latent image, and forms an image on a recording sheet 29 in an intermediate transfer method.

The image forming unit 90 functions as a tandem type image forming unit for forming an image according to image data and is disposed under the intermediate transfer belt 10 in a vertical direction. The image forming unit 90 includes photoconductors 1Y, 1M, 1C, and 1K, chargers 4Y, 4M, 4C, and 4,K, development units 6Y, 6M, 6C, and 6K, and cleaning units 3Y, 3M, 3C, and 3K respectively including cleaning blades 2Y, 2M, 2C, and 2K.

The photoconductors 1Y, 1M, IC, and 1K are disposed in the image forming apparatus 100 in a manner that shafts of the photoconductors 1Y, 1M, 1C, and 1K are disposed in a direction which horizontally extends from a front to a back of the image forming apparatus 100. The shafts are disposed parallel to each other on a common horizontal plane. According to this non-limiting embodiment, the photoconductors 1Y, 1M, 1C, and 1K respectively rotate in rotating directions A, B, C, and D at a peripheral speed of about 150 mm/sec.

The chargers 4Y, 4M, 4C, and 4K are respectively disposed around the photoconductors 1Y, 1M, 1C, and 1K and uniformly charge surfaces of the photoconductors 1Y, 1M, 1C, and 1K. The chargers 4Y, 4M, 4C, and 4K are contact type chargers. Namely, the chargers 4Y, 4M, 4C, and 4K respectively include charging rollers which contact the surfaces of the photoconductors 1Y, 1M, 1C, and 1K and rotate in accordance with rotation of the photoconductors 1Y, 1M, 1C, and 1K. However, the chargers 4Y, 4M, 4C, and 4K may respectively include non-contact type chargers. According to this non-limiting embodiment, a high-voltage power source (not shown) applies an AC (alternating-current) bias and a DC (direct-current) bias to each of the chargers 4Y, 4M, 4C, and 4K to uniformly charge the surface of each of the photoconductors 1Y, 1M, 1C, and 1K so that each of the photoconductors 1Y, 1M, 1C, and 1K has a surface potential of about −500 V.

Exposure units (not shown) are respectively disposed under the photoconductors 1Y, 1M, 1C, and 1K in the vertical direction. The exposure units respectively irradiate lights 5Y, 5M, 5C, and 5K onto the surfaces of the photoconductors 1Y, 1M, 1C, and 1K according to image data to form electrostatic latent images corresponding to yellow, magenta, cyan, and black colors on the surfaces of the photoconductors 1Y, 1M, 1C, and 1K. The exposure units may include laser beam scanners using laser diode.

The development units 6Y, 6M, 6C, and 6K are respectively disposed around the photoconductors 1Y, 1M, 1C, and 1K and develop the electrostatic latent images formed on the surfaces of the photoconductors 1Y, 1M, 1C, and 1K with yellow, magenta, cyan, and black toner. According to this non-limiting embodiment, each of the development units 6Y, 6M, 6C, and 6K performs a two-component non-magnetic contact development. Specifically, a high-voltage power source (not shown) applies a predetermined development bias to a development roller which carries a developer and is disposed in each of the development units 6Y, 6M, 6C, and 6K. Toner particles contained in the developer are moved and adhered to the electrostatic latent image formed on the surface of each of the photoconductors 1Y, 1M, 1C, and 1K. Thus, a toner image corresponding to the electrostatic latent image is formed on the surface of each of the photoconductors 1Y, 1M, 1C, and 1K.

Figure 2:
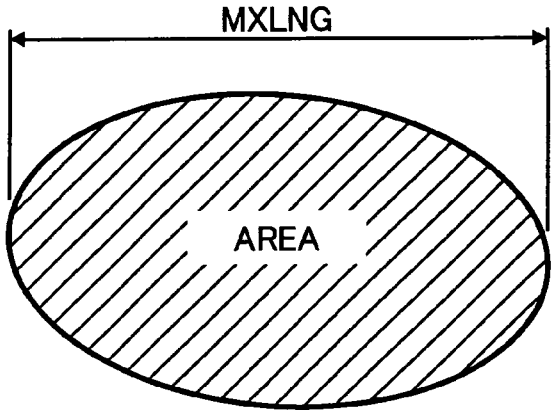
FIG. 2 is an illustration illustrating a typical shape of a toner particle having a shape factor SF-1.
Figure 3:
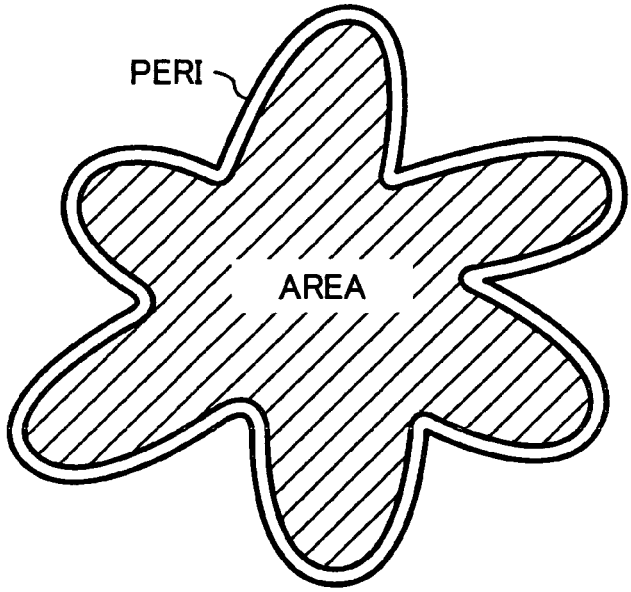
FIG. 3 is an illustration illustrating a typical shape of a toner particle having a shape factor SF-2.

The toner used in this non-limiting embodiment includes a polymer toner produced in a polymerization method. A toner particle of the polymer toner has a shape factor SF-1 of about 100 to about 180 and a shape factor SF-2 of about 100 to about 180. FIG. 2 illustrates a typical shape of the toner particle having the shape factor SF-1. FIG. 3 illustrates a typical shape of the toner particle having the shape factor SF-2.

The shape factor SF-1 indicates a degree of sphericity of the toner particle and is represented by an equation 1 below. The shape factor SF-1 is calculated by squaring a maximum length MXLNG of a toner particle projected on a two-dimensional plane, dividing the squared value by an area AREA of the projected toner particle, and multiplying the divided value by $100\times\pi/4$. When the shape factor SF-1 is 100, the toner particle has a spherical shape. The greater the shape factor SF-1 is, the more amorphous shape the toner particle has.

$$SF\text{-}1=\{(MXLNG)^2/\mathrm{AREA}\}\times(100\times\pi/4) \quad \text{[Equation 1]}$$

The shape factor SF-2 indicates a degree of a concavo-convex shape of the toner particle and is represented by an equation 2 below. The shape factor SF-2 is calculated by squaring a peripheral length PERI of a toner particle projected on a two-dimensional plane, dividing the squared value by an area AREA of the projected toner particle, and multiplying the divided value by $100\times\pi/4$. When the shape factor SF-2 is 100, a surface of the toner particle is not concavo-convex. The greater the shape factor SF-2 is, the greater the degree of the concavo-convex shape of the surface of the toner particle becomes.

$$SF\text{-}2=\{(PERI)^2/\mathrm{AREA}\}\times(100\times\pi/4) \quad \text{[Equation 2]}$$

The shape factors SF-1 and SF-2 were calculated by photographing the toner particle with a scanning electron microscope S-800 available from Hitachi, Ltd. and analyzing the photographed image with an image analyzer LUZEX III available from NIRECO Corporation.

When toner particles have a sphere-like shape, the toner particles contact each other at a small area formed between the surfaces of the toner particles. The toner particles nearly point-contact each other and the adhering force between the toner particles becomes weaker. As and a result, the fluidity of the toner particles becomes greater. The toner particle also contacts the surface of the photoconductor 1Y, 1M, 1C, or 1K at a small area formed between the surfaces of the toner particle and the photoconductor 1Y, 1M, 1C, or 1K. The toner particle nearly point-contacts the surface of the photoconductor 1Y, 1M, 1C, or 1K and the adhering force between the toner particle and the photoconductor 1Y, 1M, 1C, or 1K becomes weaker. As a result, the fluidity of the toner particle becomes greater. Thus, the toner particle is transferred onto the intermediate transfer belt 10 at an increased transfer rate. When any one of the shape factors SF-1 and SF-2 exceeds 180, the toner particle is transferred onto the intermediate transfer belt 10 at a decreased transfer rate.

The intermediate transfer unit 40 functions as a belt unit which is attachable to and detachable from the image forming apparatus 100. The toner images in the yellow, magenta, cyan, and black colors respectively formed on the surfaces of the photoconductors 1Y, 1M, 1C, and 1K are superimposed and transferred onto the intermediate transfer belt 10 in a first transfer process. The intermediate transfer belt 10 is looped over rotating supports including the second transfer bias roller 21, the first transfer bias rollers 11, 12, 13, and 14, the sensor roller 16, the second transfer entrance roller 19, and the belt cleaning roller 20, and functions as an image carrier for carrying a toner image on its outer circumferential surface. The first transfer bias rollers 11, 12, 13, and 14 form a first transferor for superimposing and transferring the toner images formed on the photoconductors 1Y, IM, 1C, and 1K onto the intermediate transfer belt 10 to form a color toner image on the intermediate transfer belt 10. The second transfer bias roller 21 forms a second transferor for transferring the color toner image formed on the intermediate transfer belt 10 onto a recording sheet 29. According to this non-limiting embodiment, a driving force is transmitted from a driver (not shown) to the second transfer bias roller 21 to rotate the second transfer bias roller 21. The rotating second transfer bias roller 21 endlessly moves the intermediate transfer belt 10 in a direction E. According to this non-limiting embodiment, the second transfer bias roller 21 functions as a rotating support-driver for supporting and driving the intermediate transfer belt 10. However, the other rotating supports may be used as the rotating support-driver.

The intermediate transfer belt 10 may be formed as an endless belt having a resin film shape. The intermediate transfer belt 10 may include vinylidene fluoride (PVDF), an ethylene-ethylene tetrafluoride copolymer (ETFE), polyimide (PI), and polycarbonate (PC), in which a conductive material (e. g., carbon black) is dispersed.

The intermediate transfer belt 10 may further include an elastic layer. The intermediate transfer belt 10 having the elastic layer may include a rubber, an elastomer, and a resin. The rubber and the elastomer may include a natural rubber, an epichlorohydrin rubber, an acrylic rubber, a silicone rubber, a fluorocarbon rubber, a polysulfide rubber, a polynorbomene rubber, an isoprene rubber, a styrene-butadiene rubber, a butadiene rubber, a butyl rubber, an ethylene-propylene rubber, an ethylene-propylene copolymer, a chloroprene rubber, a chlorosulfonated polyethylene, a chlorinated polyethylene, an acrylonitrilebutadiene rubber, an urethane rubber, a syndiotactic 1,2-polybutadiene, a hydrogenated nitrile rubber, and a thermoplastic elastomer (e.g. s polystyrene, polyolefin, polyvinyl chloride, polyurethane, polyamide, polyesters and fluoroplastic). One or more of the above-described materials may be used. The resin may include a phenolic resin, an epoxy resin, a polyester resin, a polyester polyurethane resin, polyethylene, polypropylenes polybutadiene, polyvinylidene chloride, an ionomer resin, a polyurethane resin, a silicone resin, a fluorocarbon resin, a ketone resin, a styrene resin (e.g., a polymer or a copolymer including styrene or a styrene derivative substitution) including polystyrene, chloropolystyrene, poly-α-methylstyrene, a styrene-butadiene copolymer, a styrene-vinyl chloride copolymer, a styrene-vinyl acetate copolymer, a styrene-malefic acid copolymer, a styrene-acrylic acid ester copolymer (e.g., a styrene-acrylic acid methyl copolymer, a styrene-ethyl acrylate copolymer, a styrene-butyl acrylate copolymer, a styrene-octyl acrylate copolymer, a styrene-phenyl acrylate copolymer, and the like), a styrene-methacrylic acid ester copolymer (e.g., a styrene-methyl methacrylate copolymer, a styrene ethyl methacrylate copolymer, a styrene-phenyl methacrylate copolymer, and the like), a styrene-α-chloromethyl acrylate copolymer, a styrene acrylonitrile-acrylic ester copolymer, and the like, a methyl methacrylate resin, a butyl methacrylate resin, an ethyl acrylate resin, a butyl acrylate resin, a denatured acrylic resin (e.g., a silicone denatured acrylic resin, a vinyl chloride resin denatured acrylic resin, an acrylic urethane resin, and the like), a vinyl chloride resin, a styrene-vinyl acetate copolymer, a vinyl chloride-vinylacetate copolymer, a resin denatured maleic acid resin, an ethylene-ethyl acrylate copolymer, a xylene resin, a polyvinyl butyral resin, a polyamide resin, and a denatured polyphenylene oxide resin. One or more of the above-described materials may be used. The conductive material may be added to adjust resistivity of the intermediate transfer belt 10. The conductive material may include a metallic powder (e.g., carbon, aluminum, nickel, and the like), metal oxide (e.g., titanium oxide and the like), and a conductive high polymer (e.g., polymethyl methacrylate containing quaternary ammonium salt, polyvinyl aniline, polyvinyl pyrrole, poly diacetylene, polyethylene imine, a high polymer containing boron, polypyrrole, and the like). One or more of the above-described materials may be used.

A surface covering layer including various resins may be preferably formed on the surface of the intermediate transfer belt 10 to prevent the surfaces of photoconductors 1Y, 1M, 1C, and 1K from being stained (i.e., bled), to prevent toner particles from adhering onto (i.e., filming) the surfaces of the photoconductors 1Y, 1M, 1C, and 1K, to control charging of toner particles, to adjust surface resistivity of the intermediate transfer belt 10, or to control the friction coefficient of the intermediate transfer belt 10. The surface covering layer may include a known resin. The known resin may include a fluorocarbon resin, an urethane resin, a polycarbonate resin, a polyvinyl acetal resin, an acrylic resin, a silicone resin, a polyester resin, an amino resin, an epoxy resin, a polyamide resin, a phenol resin, an alkyd resin, a melamine resin, a ketone resin, an ionomer resin, a polybutadiene resin, a chlorinated polyethylene, a vinylidene chloride resin, an acrylic urethane resin, an acrylic silicone resin, an ethylene vinyl acetate resin, a vinyl chloride acetate resin, a styrene acrylic resin, a styrene butadiene resin, a styrene malefic acid resin, and an ethylene acrylic resin. One or more of the above-described materials may be used.

According to this non-limiting embodiment, the intermediate transfer belt 10 is formed in a single layer including PI (polyimide) and carbon black, and has a thickness of about 100 μm. The intermediate transfer belt 10 may preferably have a volume resistivity in a range of about $10^7\Omega\cdot$cm to about $10^{12}\Omega\cdot$cm and a surface resistivity in a range of about $10^9\Omega\cdot$cm to about $10^{15}\Omega\cdot$cm. When the volume resistivity and the surface resistivity of the intermediate transfer belt 10 exceed the above-described ranges, an increased bias may be required for transfer, resulting in consuming an increased amount of electric power. Further, discharging performed in processes for transferring toner images and separating a recording sheet 29 from the intermediate transfer belt 10 may increase an electric potential of the charged surface of the intermediate transfer belt 10. It may also be difficult for the intermediate transfer belt 10 to perform self-discharging. Thus, a discharger may be required for discharging the intermediate transfer belt 10, resulting in an increase in manufacturing costs. When the volume resistivity and the surface resistivity of the intermediate transfer belt 10 are below the above-described ranges, the electric potential of the charged intermediate transfer belt 10 may easily decay, helping self-discharging. However, an electric current may flow on the surface of the intermediate transfer belt 10 during transfer and toner particles may spread, resulting in producing a blurred image of decreased quality.

The resistivities of the intermediate transfer belt 10 were measured as described below. A probe conforming to JIS-K6911 and having an interior electrode diameter of about 50 mm and a ring electrode inside diameter of about 60 mm was connected to a digital extra-high resistivity minute electric current ammeter R8340A available from ADVANTEST CORPORATION. To measure the volume resistivity, a voltage of about 1,000 V was applied to outer and inner circumferential surfaces of the intermediate transfer belt 10 and discharging was performed for about 5 seconds. To measure the surface resistivity, a voltage of about 500 V was applied to outer and inner circumferential surfaces of the intermediate transfer belt 10 and discharging was performed for about 10 seconds. The environmental temperature was fixed at about 22 degrees centigrade and the environmental humidity was fixed at about 55 percent.

A high-voltage power source (not shown) applies a first transfer bias to each of the four first transfer bias rollers 11, 12, 13, and 14 over which the intermediate transfer belt 10 is looped. Thus, a first transfer is performed in 4 first transfer area formed between a portion on the outer circumferential surface of the intermediate transfer belt 10 opposed by each of the first transfer bias rollers 11, 12, 13, and 14 and a portion on the surface of each of the photoconductors 1Y, 1M, 1C, and 1K. Each of the first transfer bias rollers 11, 12, 13, and 14 includes an elastic layer for forming a first transfer nip where each of the first transfer bias rollers 11, 12, 13, and 14 faces each of the 4 photoconductors 1Y, 1M, 1C, and 1K via the intermediate transfer belt 10.

The cleaning units 3Y, 3M, 3C, and 3K are respectively disposed around the photoconductors 1Y, 1M, 1C, and 1K and remove residual toner particles remaining on the photoconductors 1Y, 1M, 1C, and 1K after the first transfer. The cleaning units 3Y, 3M, 3C, and 3K respectively include the cleaning blades 2Y, 2M, 2C, and 2K which respectively contact the surfaces of the photo conductors 1Y, 1M, 1C, and 1K to clean the surfaces of the photoconductors 1Y, 1M, 1C, and 1K by scraping the residual toner particles of the surfaces of the photoconductors 1Y, 1M, 1C, and 1K.

A second transfer is performed in a second transfer area formed between a portion on the outer circumferential surface of the intermediate transfer belt 10 opposed by the second transfer bias roller 21 and a portion on a surface of the second transfer roller 22. The color toner image form d on the intermediate transfer belt 10 is transferred onto a recording sheet 29 conveyed through the second transfer area. The second transfer roller 22 is grounded and a high-voltage power source (not shown) is connected to the second transfer bias roller 21. According to this non-limiting embodiment, a second transfer bias of about −2,000 V is applied to the second transfer bias roller 21. The second transfer bias roller 21 includes a metal core including SUS, and an elastic body covering the metal core and including urethane which is adjusted to have a resistivity in a range of about $10^6\Omega$ to about $10^{10}\Omega$ with a conductive material. When the second transfer roller 22 has a resistivity exceeding the above-described range, a transfer current may not easily flow and a higher transfer bias may be required to enable proper transfer, resulting in an increase of electric power cost. The higher transfer bias may generate discharging in spaces created before and after a nip farmed in the second transfer area in a sheet conveyance direction, and the discharging may produce half-tone image of decreased quality having white spots or the like. This may often occur in an environment of low temperature (e.g., about 1 degrees centigrade) and low humidity (e.g., about 15 percent). When the second transfer roller 22 has a resistivity below the above-described range, high quality transfer may not be performed for both a superimposed portion of an image formed by superimposed toner images in two or more colors and a non-superimposed portion of the image formed by a non-superimposed toner image. Namely, a relatively low transfer bias set to flow a transfer current which is sufficient to transfer the non-superimposed portion may not be sufficient t transfer the superimposed portion. A relatively high transfer bias set to flow a transfer current which is sufficient to transfer the superimposed portion may decrease transfer efficiency because the transfer current may be an overflow for the non-superimposed portion. The second transfer roller 22 is disposed on a conductive metal plate and a weight of about 4.9 N is applied to each of the ends of its core. Namely, a total weight of about 9.8 N is applied to the ends of the core. The resistivity of the second transfer roller 22 is calculated based on an amount of an electric current flown when 4 voltage of about 1,000 V is applied between the core and the conductive metal plate. An environmental temperature was fixed at about 122 degrees centigrade and an environmental humidity was fixed at about 55 percent when measurement was performed. According to this non-limiting embodiment, the second transfer roller 22 is adjusted to have a resistivity of about 7.8 Log Ω.

The resistivity of the first transfer bias rollers 11, 12, 13, and 14 may preferably be set in a range similar to that of the second transfer roller 22 because of the above-described reasons for the second transfer roller 22. According to this non-limiting embodiment, the resistivity of the first transfer bias rollers 11, 12, 13, and 14 is adjusted to be about 7.0 Log Ω. The resistivity of the first transfer bias rollers 11, 12, 13, and 14 is measured in a method similar to that in which the resistivity of the second transfer roller 22 is measured.

The pick-up roller 28, the feeding roller 27, and the registration roller 26 feed a recording sheet 29 to the second transfer area at a timing when a head of the color toner image formed on the intermediate transfer belt 10 enters the second transfer area. The curvature of the second transfer roller 22 and a predetermined separation bias applied by the separator 30 separate t e recording sheet 29 from the intermediate transfer belt 10. The recording sheet 29 is then conveyed to the fixing unit 25. The fixing unit 25 fixes the color toner image on the recording sheet 29 and the recording sheet 29 is output to an outside of the image forming apparatus 100.

The belt cleaning unit 24 is disposed to oppose the belt cleaning roller 20 via the intermediate transfer belt 10 and removes residual toner particles remaining on the outer circumferential surface of the intermediate transfer belt 10 after the second transfer. The belt cleaning unit 24 includes the cleaning blade 23 which contacts the outer circumferential surface of the intermediate transfer belt 10. The cleaning blade 23 scrapes the residual toner particles remaining on the outer circumferential surface of the intermediate transfer belt 10 to clean the outer circumferential surface of the intermediate transfer belt 10.

According to this non-limiting embodiment, the fixing processing speed may be changed in accordance with type of a recording sheet 29. Specifically, the fixing processing speed of a recording sheet 29 having a basis weight of 110 kg or more may be set to half of a regular fixing processing speed. The basis weight indicates a weight of 1,000 sheets having a same size and is measured in kilograms. Thus, the recording sheet 29 may pass a fixing nip armed between the rollers 33 and 34 by taking a time about twice as long as a regular time, providing sufficient time for fixing. When the fixing processing speed is set to half of the regular fixing processing speed, the second transfer for transferring the color toner image formed on the intermediate transfer belt 10 onto the recording sheet 29 may also be performed at a speed half of a regular transfer speed. When the fixing processing speed is set to half of the regular fixing processing speed, a thick paper mode is selected for a second transfer bias applied to the second transfer bias roller 21. According to this non-limiting embodiment, the type of the recording sheet 29 may be selected on a control panel (not shown) among a plain paper mode for providing the regular fixing processing speed, and the thick paper mode and an OHP (overhead projector) mode for providing a speed half of the regular fixing processing speed.

According to this non-limiting embodiment, an operator of the image forming apparatus 100 may select any one of image forming modes on the control panel. The image forming modes include a monochrome mode for forming an image in any one of the yellow, magenta, cyan, and black colors, a two-color mode for forming an image by superimposing toner images in any two colors among the four colors, a three-color mode for forming an image by superimposing toner images in any three colors among the four colors, and a full-color mode for forming an image by superimposing toner images in the four colors.

According to this non-limiting embodiment, when the positions of toner images transferred on the intermediate transfer belt 10 are shifted with respect to each other, the positions are corrected in a color-shift correction mode. The density of a toner image in each of the four colors is corrected in a density adjustment mode. The sensor 17 disposed to oppose the sensor roller 16 via the intermediate transfer belt 10 is used to perform the above-described corrections while an image is not formed.

Specifically, in the color-shift correction mode, a toner pattern is formed on the surface of each of the photoconductors 1Y, 1M, 1C, and 1K and each toner pattern is transferred onto the intermediate transfer belt 10. The position of each toner pattern is determined based on the timing when the sensor 17 detects the toner pattern to calculate relative shifts among positions of the toner patterns in the four colors. Timings of the exposures performed by the exposure units are adjusted to correct the shifts.

In the density adjustment mode, a toner pattern is formed on the surface of each of the photoconductors 1Y, 1M, 1C, and 1K and each toner pattern is transferred onto the intermediate transfer belt 10. The density of each toner pattern is determined based on the amount of light charging received by the sensor 17 to correct the charging bias of each of the chargers 4Y, 4M, 4C, and 4K and the development bias of each of the development units 6Y, 6M, 6C, and 6K so that the density of each toner pattern reaches a target density. The color-shift correction made and the density adjustment mode may be configured otherwise than as specifically described above.

Figure 4:
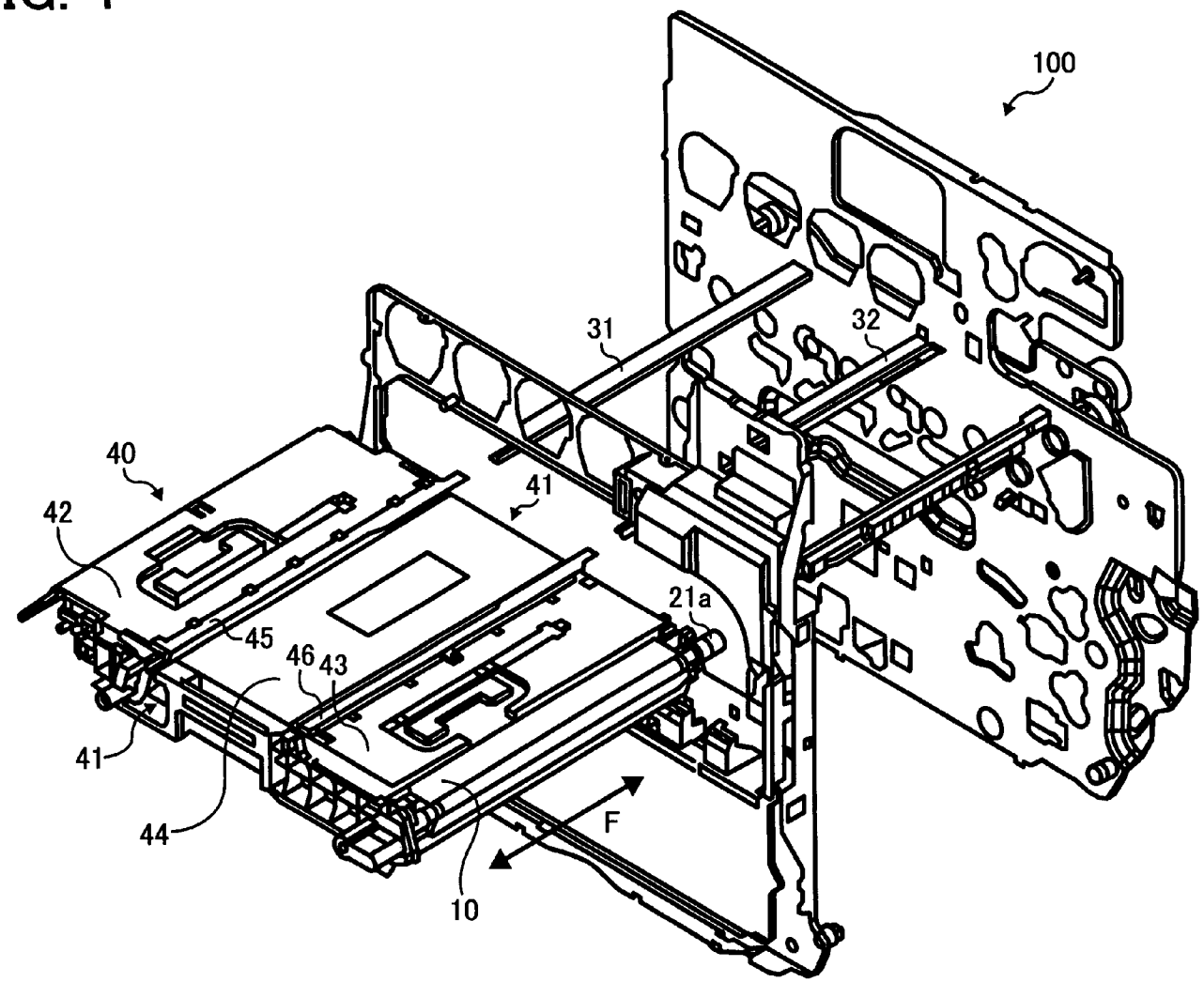
FIG. 4 is a perspective view of an intermediate transfer unit and guide rails of the image forming apparatus shown in FIG. 1.

As illustrated in FIG. 4, the image forming apparatus 100 further includes guide rails 31 and 32. The intermediate transfer unit 40 further includes supporting frames 41, covers 42, 43, and 44, guided members 45 and 46, and a shaft and 21*a*.

The intermediate transfer unit 40 functions as a belt unit which is attachable to and detachable from the image forming apparatus 100 in a direction F (i.e., a substantially horizontal direction).

The rotating supports are disposed in the intermediate transfer unit 40 in a manner that shafts of the rotating supports are disposed parallel to the direction F. The interior walls of the supporting frames 41 rotatably support the rotating supports at both ends of the rotating supports in the direction F. The shaft end 21*a* is disposed on a shaft end of the second transfer bias roller 21, which faces the image farming apparatus 100 into which the intermediate transfer unit 40 is inserted, and protrudes from the intermediate transfer unit 40. When the intermediate transfer unit 40 is installed in the image forming apparatus 100, the shaft end 21 is coupled to a driving shaft (not shown) connected to a driving source (not shown) of the image forming apparatus 100.

The covers 42, 43, and 44 cover the outer circumferential surface of the intermediate transfer belt 10, which faces upward in the vertical direction when the intermediate transfer unit 40 is installed in the image forming apparatus 100. According to this non-limiting embodiment, the covers 42, 43, and 44 cover a full length of the outer circumferential surface of the intermediate transfer belt 10 in the direction F. However, the covers 42, 43, and 44 may partially cover the outer circumferential surface of the intermediate transfer belt 10 in the direction F. The covers 42, 43, and 44 prevent unnecessary substances (e.g., metal powder generated inside the image forming apparatus 100) from adhering to the outer circumferential surface of the intermediate transfer belt 10. Therefore, the covers 42, 43, and 44 may preferably cover the entire outer circumferential surface of the intermediate transfer belt 10. In this case, however, the covers 42, 43, and 44 may disturb proper operations of various mechanisms including the photoconductors 1Y, 1M, 1C, and 1K, the second transfer roller 22, the sensor 17, and the belt cleaning unit 24, which are performed between the outer circumferential surface of the intermediate transfer belt 10 and those mechanisms when the intermediate transfer unit 40 is installed in the image forming apparatus 100. To avoid this, mechanism for moving the covers 42, 43, and 44 to positions where the covers 42, 43, and 44 may not disturb the proper operations of the above-described mechanisms surrounding the intermediate transfer belt 10 is required when the intermediate transfer unit 40 is installed in the image forming apparatus 100. Therefore, the covers 42, 43, and 44 may preferably cover only portions on the outer circumferential surface of the intermediate transfer belt 10 where the covers 42, 43, and 44 may not disturb the proper operations of the above-described mechanisms surrounding the intermediate transfer belt 10. Specifically, the covers 42, 43, and 44 cover the entire outer circumferential surface of the intermediate transfer belt 10 between the sensor 17 and the cleaning blade 23, which faces upward in the vertical direction when he intermediate transfer unit 40 is installed in the image forming apparatus 100. Generally, the unnecessary substances are often gravitated down toward the outer circumferential surface of the intermediate transfer belt 10. Therefore, the covers 42, 43, and 44 may preferably cover the outer circumferential surface of the intermediate transfer belt 10 which faces upward in the vertical direction when the intermediate transfer unit 40 is installed in the image forming apparatus 100.

The covers 42, 43, and 44 may include a resin (e.g., acrylonitrile-butadiene-styrene (ABS), polystyrene (PS), and the like) or a metal. However, the covers 42, 43, and 44 may preferably include the resin because the covers 42, 43, and 44 may generally be molded more easily at a decreased cost to have a lighter weight with the resin than with the metal. According to this non-limiting embodiment, the covers 42, 43, and 44 include PS. The cover 43 which is disposed near the second transfer bias roller 21 is positioned near the fixing unit 25 when the intermediate transfer unit 40 is installed in the image forming apparatus 100. Thus, the fixing unit 25 may heat the cover 43. To avoid this, the resin, which is not heated as easily as the metal, may be preferably used.

The covers 42 and 43 respectively include the guided members 45 and 46 along edges provided on sides of the covers 42 and 43 which face each other via the cover 41. The guided members 45 and 46 may include the resin or the metal. According to this non-limiting embodiment, the guided members 45 and 46 are integrally molded with the covers 42 and 43 by using PS respectively. When the intermediate transfer unit 40 is inserted into or removed from the image forming apparatus 100, the guided members 45 and 46 are respectively engaged with the guide rails 31 and 32 including a metal to guide the intermediate transfer unit 40. The guide rails 31 and 32 are disposed in the image forming apparatus 100 and function as guide members for guiding the intermediate transfer unit 40 when the intermediate transfer unit 40 is inserted into or removed from the image forming apparatus 100. According to this non-limiting embodiment, the guide rails 31 and 32 support the intermediate transfer unit 40 via the guided members 45 and 46 when the intermediate transfer unit 40 is inserted into or removed from the image forming apparatus 100.

Figure 5:
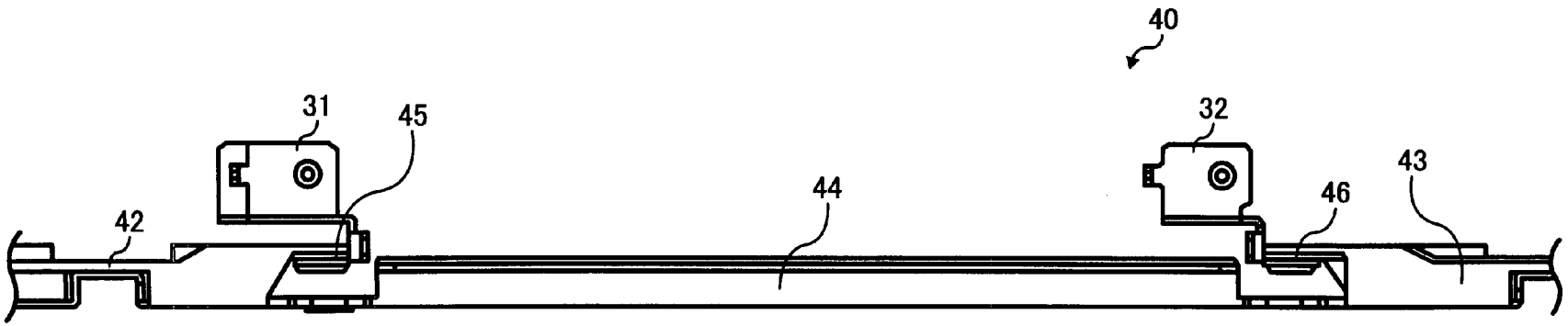
FIG. 5 is a side view of covers of the intermediate transfer unit shown in FIG. 4.

FIG. 5 is a side view of the covers 42, 43, and 44 according to this non-limiting embodiment. In FIG. 5, the guided members 45 and 46 are respectively engaged with he guide rails 31 and 32. Both side ends of the cover 44, which are horizontally disposed in a direction perpendicular to the direction F shown in FIG. 4 when the intermediate transfer unit 40 is inserted into or removed from the image forming apparatus 100, respectively protrude under the guided members 45 and 46. A part of each of the guide rails 31 and 32 moves in a space formed under each of the covers 45 and 46 and above each of the side ends of the cover 44 to support and guide the intermediate transfer unit 40 into the image forming apparatus 100. When the intermediate transfer unit 40 is inserted into or removed from the image forming apparatus 100, lower surfaces of the guided members 45 and 46 respectively slide on upper surfaces of the guide rails 31 and 32. Therefore, the guided members 41 and 46 and the guide rails 31 and 32 may respectively be scraped against each other and may generate powders. When the powders fall onto and adhere to the outer circumferential surface of the intermediate transfer belt 10, the powders may damage the intermediate transfer belt 10 and the cleaning blade 23, producing an image of decreased quality. According to this non-limiting embodiment, the cover 44 functions as a shield for shielding portions on the outer circumferential surface of the intermediate transfer belt 10 under the guided members 45 and 46. Specifically, the both side ends of the cover 44 respectively protruding under the guided members 45 and 46 are connected to the covers 42 and 43. Namely, no opening through which the powders fall onto the intermediate transfer belt 10 is created under the guided members 45 and 46. Thus, the powders may not fall onto the outer circumferential surface of the intermediate transfer belt 10. The above-described structure creating no opening between the cover 44 and the covers 42 and 43 may also effectively prevent substances other than the above-described powders (e.g., metal powders generated in the image forming apparatus 100) from falling onto the outer circumferential surface of the intermediate transfer belt 10.

As described above, according to this non-limiting embodiment, the guide rails 31 and 32 respectively support the intermediate transfer unit 40 via the guided members 45 and 46. The intermediate transfer unit 40 weighs on the guide rails 31 and 32 and the guided members 45 and 46 integrally molded with the covers 42 and 43 respectively. According to this non-limiting embodiment, the guide rails 31 and 32 include a metal and have a rigidity such that the guided rails 31 and 32 are not deformed even when the intermediate transfer unit 40 weighs on the guided rails 31 and 32. The guided members 45 and 46 do not have a rigidity sufficient to support the weight, of the intermediate transfer unit 40 because the guided members 45 and 46 are integrally molded with the covers 42 and 43 respectively and include the material (e.g., PS) common to the covers 42 and 43. To solve this problem, according to this non-limiting embodiment, deformation preventing members are provided to increase a rigidity of the covers 42 and 43 and thereby prevent deformation of the covers 42 and 43.

Figure 6:
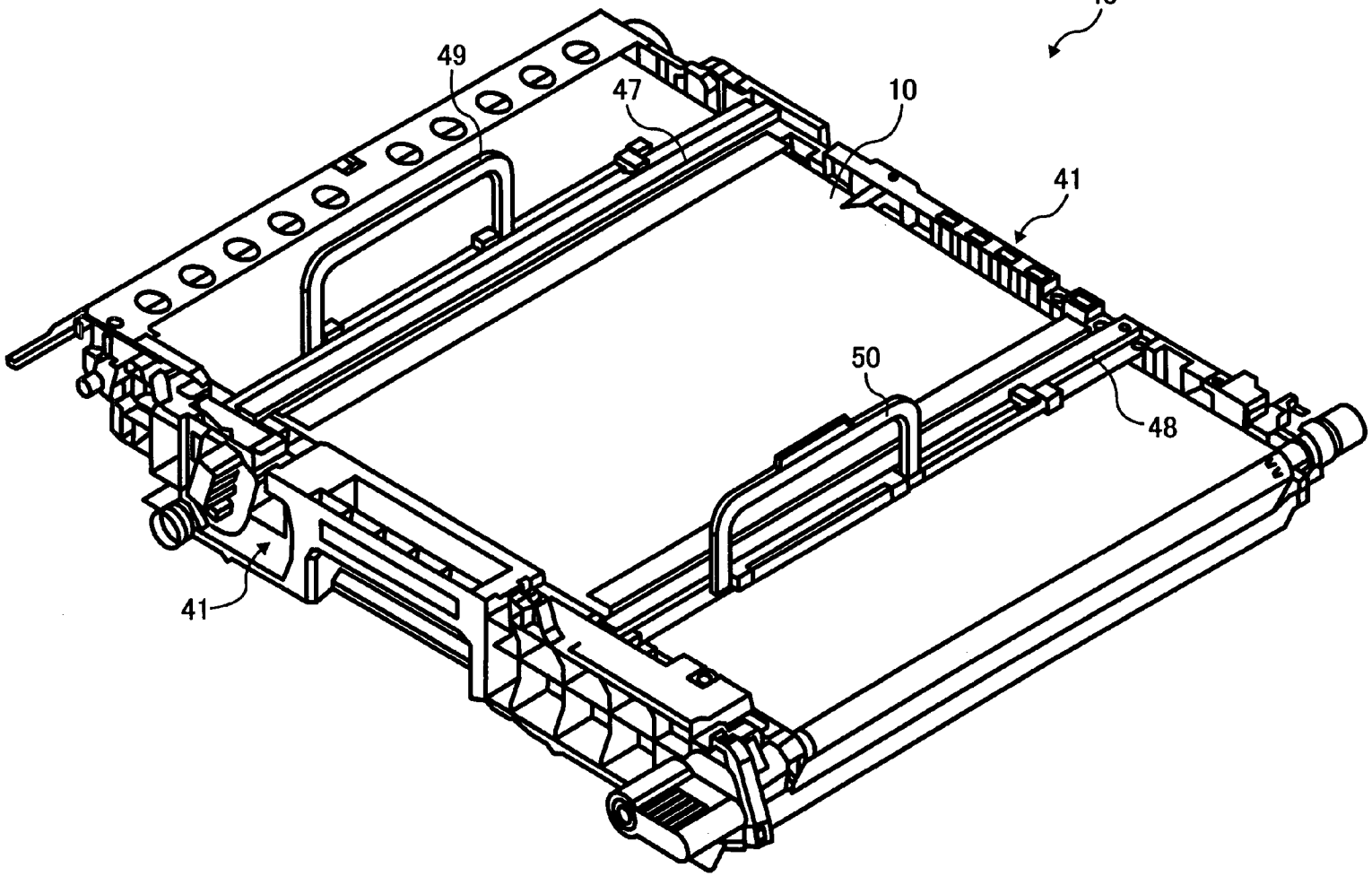
FIG. 6 is a perspective view of the intermediate transfer unit shown in FIG. 4 without the covers shown in FIG. 5.

FIG. 6 is a perspective view of the intermediate transfer unit 40 without the covers 42, 43, and 44 according to this non-limiting embodiment. As illustrated in FIG. 6, the intermediate transfer unit 40 further includes stays 47 and 48 and handles 49 and 50.

The stays 47 and 48 are disposed between the supporting frames 41 and function as the deformation preventing members. Both ends of each of the stays 47 and 48 are respectively fixed to both of the supporting frames 41. The handles 49 and 50 are swingably attached to the stays 47 and 48, respectively.

Figure 7:
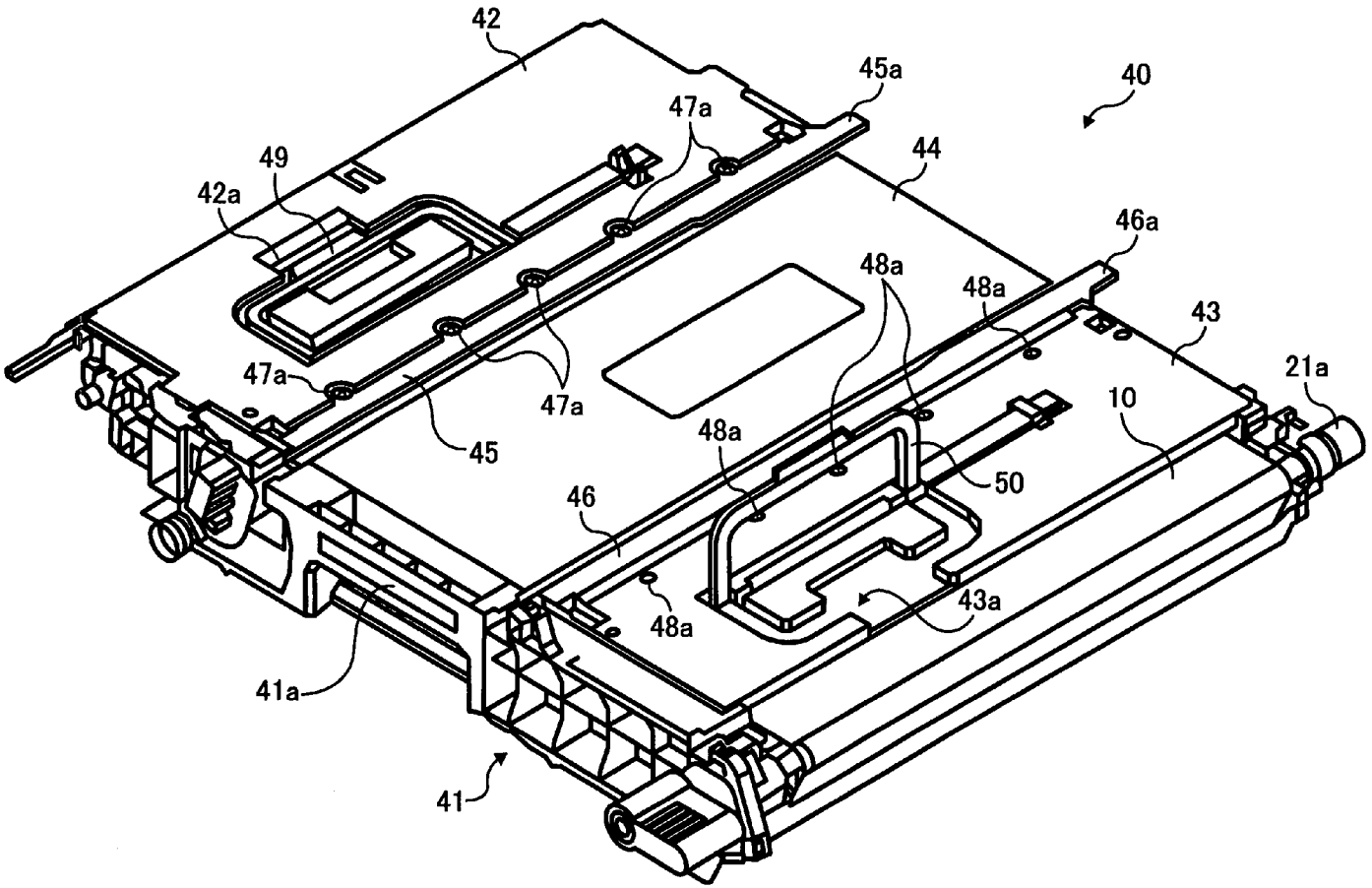
FIG. 7 is a perspective, view of the intermediate transfer unit shown in FIG. 4.

FIG. 7 is a perspective view of the intermediate transfer unit 40 according to this non-limiting embodiment. As illustrated in FIG. 7, the intermediate transfer unit 40 further includes screws 47*a* and 48*a*, concave portions 42*a*,and 43*a*, end portions 45*a* and 46*a*, and a pull 41*a*.

The screws 47*a* and 48*a* respectively secure the stays 47 and 48 to interior surfaces of the covers 42 and 43 near the guided members 45 and 46 and along a longitudinal direction of the guided members 45 and 46. The stays 47 and 48 include a material (e.g., a metal) having a rigidity greater than that of the covers 42 and 43. The stays 47 and 48 configured as described above may respectively prevent the covers 42 and 43 from deforming even when the intermediate transfer unit 40 weighs on the covers 42 and 43 while the intermediate transfer unit 40 is inserted into or removed from the image forming apparatus 100.

The handles 49 and 50 are respectively disposed and exposed on outer surfaces of the covers 42 and 4 so that the operator of the image forming apparatus 100 may grip the handles 49 and 50. The concave portions 42*a* and 43*a* are respectively disposed on the outer surfaces of the covers 42 and 43 and respectively hold the handles 49 and 50. The handle 49 and the concave portion 42*a* shown in FIG. 7 illustrate a holding position at which the concave portion 42*a* holds the handle 49, and the handle 50 and the concave portion 43*a* shown in FIG. 7 illustrate a grip position at which the handle 50 protrudes from the outer surface of the cover 43 so that the operator of the image forming apparatus 100 may grip the handle 50.

To insert the intermediate transfer unit 40 into the image forming apparatus 100, the operator of the image forming apparatus 100 swings the handles 49 and 50 from the holding position to the grip position and grips the handles 49 and 50 with both hands to carry the intermediate transfer unit 40. Then, the operator positions the guided members 45 and 46 with respect to the corresponding guide rails 31 and 32 to engage the guided members 45 and 46 with the guide rails 31 and 32.

The end portions 45*a* and 46 are respectively disposed on ends of the guided members 45 and 46 facing the image forming apparatus 100 when the intermediate transfer unit 40 is inserted into the image forming apparatus 100, and protrude from an outer surface of the supporting frame 41 facing the image forming apparatus 100 when the intermediate transfer unit 40 is inserted into the image forming apparatus 100. According to this non-limiting embodiment, the end portions 45*a* and 46*a* protrude by about 20 mm. The operator places the end portions 45*a* and 46*a* on end portions of the guide rails 31 and 32, which respectively face the end portions

45*a* and 46*a*, to position the guided members 45 and 46 with respect to the guide rails 31 and 32. Thus, the operator may easily engage the guided members 45 and 46 with the guide rails 31 and 32. Such easy engaging operation may be important to reduce errors made by the operator during the engaging operation. Particularly, when the operator is a general user instead of an expert (e.g., a service engineer), the easy engaging operation may be important.

To make the engaging operation even easier, outer surfaces of the end portions 45*a* and 46*a* may preferably include markings indicating positions to be engaged with the guide rails 31 and 32 respectively. For example, the markings may be similar to markings provided on the end portions of the guide rails 31 and 32. The markings may cause the operator to easily identify the end portions 45*a* and 46*a* to be engaged with the guide rails 31 and 32 respectively, thereby providing easy engaging operation for the operator and reducing errors made by the operator during the engaging operation. According to this non-limiting embodiment, the guided members 45 and 46 are integrally molded with the covers 42 and 43 respectively by using a common material having a common color. Therefore, the operator may not easily identify the end portions 45*a* and 46*a* to be engaged with the guide rails 31 and 32 respectively. The markings provided on the end portions 45*a* and 46*a* may effectively help the operator in identifying the end portions 45*a* and 46*a*. The markings may include prints and labels put on the outer surface of the end portions 45*a* and 46*a*.

According to this non-limiting embodiment, the guided members 45 and 46 are disposed near a center of the intermediate transfer unit 40 in the direction perpendicular to the direction F shown in FIG. 4. In a tandem type image forming apparatus such as the image forming apparatus 100 according to this non-limiting embodiment, a portion of the intermediate transfer belt 10 facing the tandem type image forming unit 90 is required to form a plane. When the intermediate transfer unit 40 is inserted into or removed from the image forming apparatus 100 in the direction shown in FIG. 4, the intermediate transfer unit 40 is horizontally long for the operator who performs the engaging operation. If the guided members 45 and 46 are respectively disposed on both en portions on an upper surface of the intermediate transfer unit 40 in the direction perpendicular to the direction F shown in FIG. 4, the operator may be required to move his or her eyes to position the guided members 45 and 46 with respect to the corresponding guide rails 31 and 32, decreasing efficiency of the engaging operation. If the guided members 45 and 46 are respectively disposed near the center of the intermediate transfer unit 40 in the direction perpendicular to the direction F shown in FIG. 4, the operator may not be required to move his or her eyes to position the guided members 45 and 46 with respect to the corresponding guide rails 31 and 32, increasing efficiency of the engaging operation.

After respectively engaging the guided members 45 and 46 with the guide rails 31 and 32 through the above-described engaging operation, the operator pushes the intermediate transfer unit 40 into the image forming apparatus 100 immediately before the handles 49 and 50 contact the front of the image forming apparatus 100. The operator moves his or her hands off the handles 49 and 50 so that the handles 49 and 50 are respectively held in the concave portions 42*a* and 43*a*. The intermediate transfer unit 40 may not fall off the image forming apparatus 100 because the guide rails 31 and 32 respectively support the intermediate transfer unit via the guided members 45 and 46. The operator further pushes the intermediate transfer unit 40 into the image forming apparatus 100. Thus, the intermediate transfer unit 40 is set inside the image forming apparatus 100.

To remove the intermediate transfer unit 40 from the image forming apparatus 100, the operator holds the pull member 41*a* disposed on an outer surface of the supporting frame 41 facing the operator when the intermediate transfer unit 40 is inserted into or removed from the image forming apparatus 100, and pulls the intermediate transfer unit 40 until the operator may set the handles 49 and 50 at the grip position. The operator moves his or her hand off the pull member 41*a*, sets the handles 49 and 50 at the grip position, grips the handles 49 and 50 with both hands, and pulls the intermediate transfer unit 40 out of the image forming apparatus 100 until the engagement of the guided members 45 and 46 with the guide rails 31 and 32 is released.

Figure 8:
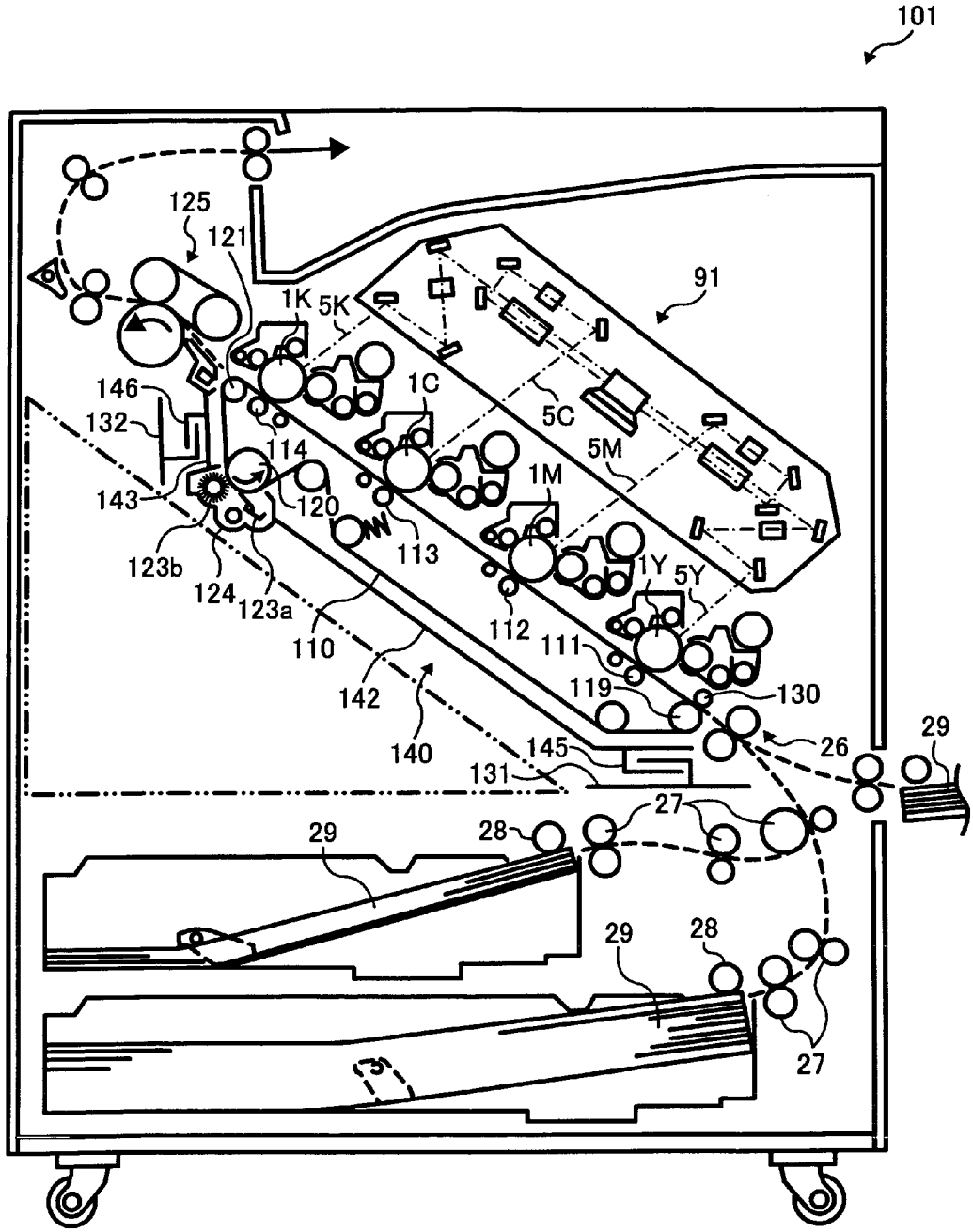
FIG. 8 is a schematic view of an image forming apparatus according to another exemplary embodiment of the present invention.

FIG. 8 illustrates an image forming apparatus 101 according to another exemplary embodiment of the present invention.

As illustrated in FIG. 8, the image forming apparatus 101 includes an image forming unit 91 including the photoconductors 1Y, 1M, 1C, and 1K, a conveyance belt unit 40 including a conveyance belt 110, transfer bias rollers 111, 112, 113, and 114, an entrance roller 119, an exit roller 121, a belt cleaning roller 120, covers 142 and 143, and guided members 145 and 146, the pick-up rollers 28, the feeding rollers 27, the registration roller 26, a charging roller 130, a fixing unit 125, a belt cleaning unit 24 including a cleaning blade 123*a* and a cleaning brush 123*b*, and guide rails 131 and 132.

The image forming apparatus 101 forms an image in the electrophotographic method. According to this non-limiting embodiment, the image forming apparatus 101 functions as a tandem type printer which includes four photoconductors as latent image carriers for carrying an electrostatic patent image and forms an image on a recording sheet 29 in a direct transfer method. Elements of the image forming apparatus 101, which are common to the image forming apparatus 100 according to a previous embodiment, are not explained below.

The image forming unit 91 functions as a tandem type image forming unit for forming an image according to image data and is disposed obliquely above the conveyance belt 110 in the vertical direction. The image forming unit 91 includes the photoconductors 1Y, 1M, 1C, and 1K. The photoconductors 1Y, 1M, 1C, and 1K are disposed in the image forming apparatus 101 in a manner that shafts of the photoconductors 1Y, 1M, 1C, and K are disposed in a direction which horizontally extends from a front to a back of the image forming apparatus 101. The shafts are disposed parallel to each other on a common plane which forms an oblique angle with respect to the horizontal plane. Exposure units (not shown) are respectively disposed obliquely upward with respect to the photoconductors 1Y, 1M, 1C, and 1K in the vertical, direction.

The conveyance belt 110 is looped over rotating supports including the transfer bias rollers 111, 112, 113, and 114, the entrance roller 119, the exit roller 121, and the belt cleaning roller 120, and functions as a sheet conveyer for conveying the recording sheet 29. A high-voltage power source (no shown) applies a transfer bias to each of the transfer bias rollers 111, 112, 113, and 114. Thus, transfer is performed in a transfer area formed between a portion on an outer circumferential surface of the conveyance belt 110 opposed by each of the transfer bias rollers 111, 112, 113, and 114 and a portion on the surface of each of the photoconductors 1Y, 1M, 1C, and 1K. Each of the transfer bias rollers 111, 112, 113, and 114 includes an elastic layer for forming a transfer nip where each of the transfer bias rollers 111, 112, 113, and 114 faces each of the photoconductors 1Y, 1M, 1C, and 1K via the conveyance belt 10.

A recording sheet 29 fed by the registration roller 26 is sent to a charging area formed between a surface of the charging roller 130 and a portion on the outer circumferential surface of the conveyance belt 110 opposed by the entrance roller 119. A power source (not shown) is connected to the charging roller 130 and applies a predetermined charging bias to the charging roller 130. While the recording sheet 29 passes the charging area, the charging roller 130 applies an electric charge to the recording sheet 29 in an amount required for the conveyance belt 110 to attract the recording sheet 29. Thus, the conveyance belt 10 may stably carry and convey the recording sheet 29 on its outer circumferential surface.

A toner image formed on each of the photoconductors 1Y, 1M, 1C, and 1K is transferred onto the recording sheet 29 carried by the conveyance belt 110 in the transfer area so that the toner images are superimposed one after another n the recording sheet 29 conveyed by the conveyance belt 110 to form color toner image on the recording sheet 29. The curvature of the exit roller 121 separates the recording sheet 29 having the color toner image from the conveyance belt 110. The recording sheet 29 is fed to and the fixing unit 125. The recording sheet 29 having the fixed image it output to an outside portion of the image forming apparatus 101.

The image forming apparatus 101, like the image forming apparatus 100, provides the monochrome, two-color, three-color, full-color modes as well as the color-shift correction and density adjustment modes.

The rotating supports including the transfer bias rollers 111, 112, 113, and 114, the entrance roller 119, the exit roller 121, the belt cleaning roller 120, the conveyance belt 110 looped over the rotating supports, the covers 142 and 143, and the guided members 145 and 146 form a conveyance belt unit 140. The conveyance belt unit 140 functions as a belt unit which is attachable to and detachable from the image forming apparatus 101. The conveyance belt unit 140 has a basic structure similar to that of the intermediate transfer unit 40 of the image forming apparatus 100 according to the previous embodiment. The conveyance belt unit 140 may be inserted into or removed from the image forming apparatus 101 in a direction similar to that of the intermediate transfer unit 40. However, the image forming unit 91 is disposed obliquely above the conveyance belt 110 in the vertical direction. If the covers 142 and 143 are disposed to cover portions on the outer circumferential surface of the conveyance belt 110 which face upward in the vertical direction when the conveyance belt unit 140 is installed in the image forming apparatus 101 like the covers 42 and 43 of the image forming apparatus 100, a mechanism for moving the covers 142 and 143 to positions where the covers 142 and 143 may not disturb proper operations of mechanisms surrounding the conveyance belt 10 is required when the conveyance belt unit 140 is installed in the image forming apparatus 101, resulting in a complex structure of the conveyance belt unit 140. Therefore, according to this non limiting embodiment, the covers 142 and 143 are disposed to cover portions on the outer circumferential surface of the conveyance belt 11 which face downward in the vertical direction when the conveyance belt unit 140 is installed in the image forming apparatus 101. The outer circumferential surface of the conveyance belt 110 includes a portion which contacts the cleaning blade 123*a* and the cleaning brush 123*b* for cleaning the outer circumferential surface of the conveyance belt 110 and is opposed by the belt cleaning roller 120. Therefore, the covers 142 and 143 cover the entire outer circumferential surface of the conveyance belt 110 which faces downward in the vertical direction when the conveyance belt unit 140 is installed in the image forming apparatus 101, except for the portion contacting the cleaning blade 123*a* and the cleaning brush 123*b*.

The guided members 145 and 146 function like the guided members 45 and 46 of the image forming apparatus 100 according to the previous embodiment. Specifically, the guided members 145 and 146 are respectively disposed on outer surfaces of the covers 142 and 143 and engage with the guide rails 131 and 132 when the conveyance belt unit 140 is inserted into or removed from the image forming apparatus 101. The guide rails 131 and 132 function as the guide members for guiding the conveyance belt unit 140 when the conveyance belt unit 140 is inserted into or removed from the image forming apparatus 101. If the guided members 145 and 146 are disposed near a center portion of the conveyance belt unit 140 in a substantially horizontal sheet conveyance direction, the conveyance belt unit 140 may not be stably inserted into or removed from the image forming apparatus 101. Therefore, the guided members 145 and 146 are respectively disposed near both end portions of the conveyance belt unit 140 in the substantially horizontal sheet conveyance direction.

Figure 9:
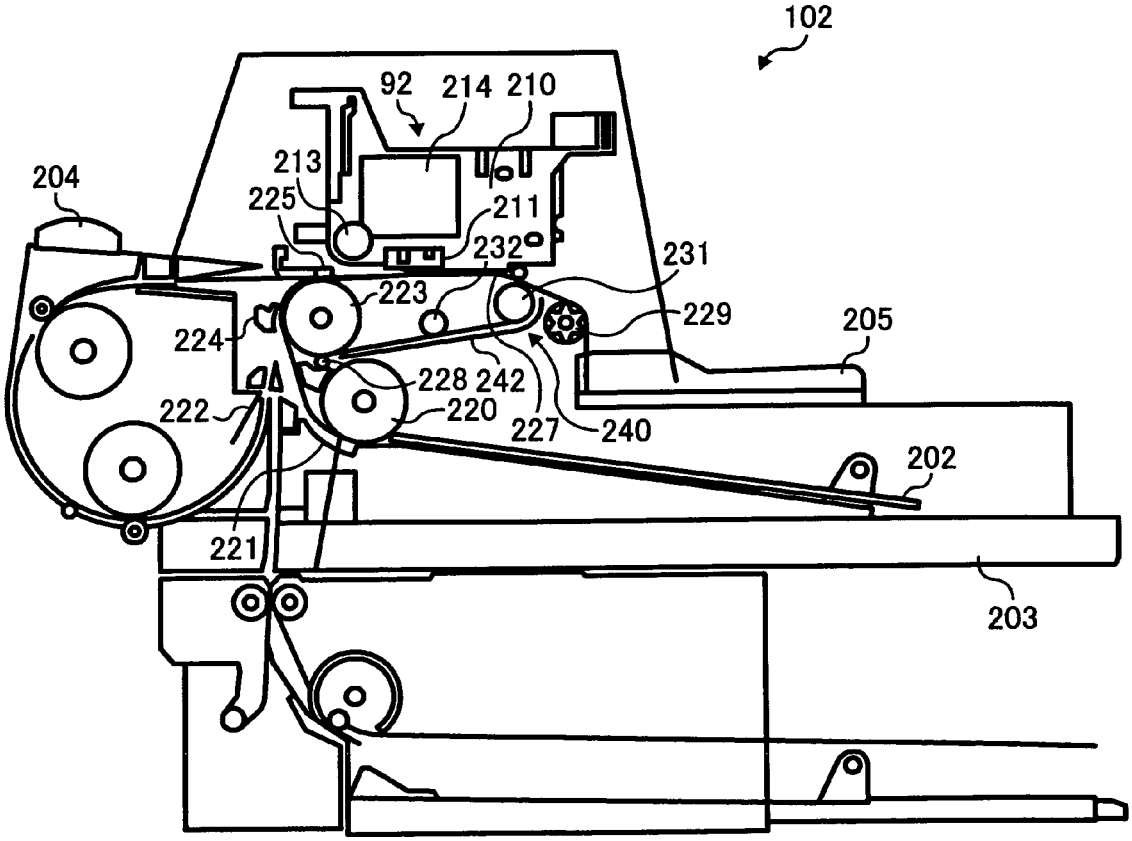
FIG. 9 is a schematic view of an image forming apparatus according to yet another exemplary embodiment of the present invention.

FIG. 9 illustrates an image forming apparatus 102 according to yet another exemplary embodiment of the present invention.

As illustrated in FIG. 9, the image forming apparatus 102 includes a paper tray 203, a bypass tray 204, an image forming unit 92 including a carriage 210 and recording heads 211, an output tray 205, a feeding roller 220, a friction pad 221, a guide 222, a driving roller 223, a conveyance belt 227, a conveyance roller 224, a head roller 225, a charger 228, and an output roller 229.

The image forming apparatus 102 functions as an inkjet recording apparatus. The image forming unit 92 functions as an inkjet image forming unit for forming an image on a recording sheet 202. The paper tray 203 is disposed in a lower portion of the image forming apparatus 102 and loads one or more recording sheets 202. The paper tray 203 is attachable to and detachable from the image forming apparatus 102. The bypass tray 204 is opened from and closed toward the image forming apparatus 102 so that an operator of the image forming apparatus 102 may place a recording sheet 202 on the bypass tray 204. A recording sheet 202 is fed from the paper tray 203 or the bypass tray 204 toward the carriage 210. The carriage 210 moves in a main scanning direction and carries the recording heads 211. Each of the recording heads 211 discharges a liquid drop of any one of the yellow, magenta, cyan, and black colors to form a color image on the recording sheet 202. The output tray 205 receives the recording sheet 202 having the color image.

The feeding roller 220 and the friction pad 221 feed recording sheets 202 from the paper tray 203 and separate the recording sheets 202 one by one to feed the separated recording sheet 202 toward the guide 222. The guide 222 guides the recording sheet 202 toward the conveyance belt 227. The driving roller 223 over which the conveyance belt 227 is looped rotates the conveyance belt 227. The conveyance belt 227 reverses and conveys the recording sheet 202 toward and under the recording heads 211, and functions as a sheet conveyer for conveying the recording sheet 202. The conveyance roller 224 presses the recording sheet 202 onto an outer circumferential surface of the conveyance belt 227. The head roller 225 regulates an angle at which the recording sheet 202 is conveyed by the conveyance belt 227.

The charger 228 charges the conveyance belt 227 so that the outer circumferential surface of the conveyance belt 227 attracts the recording sheet 202. Thus, the surface of the recording sheet 202 is conveyed parallel to the recording heads 211. The output roller 229 is disposed downstream of the conveyance belt 227 in a sheet conveyance direction and feeds the recording sheet 202 onto the output tray 205.

Figure 10:
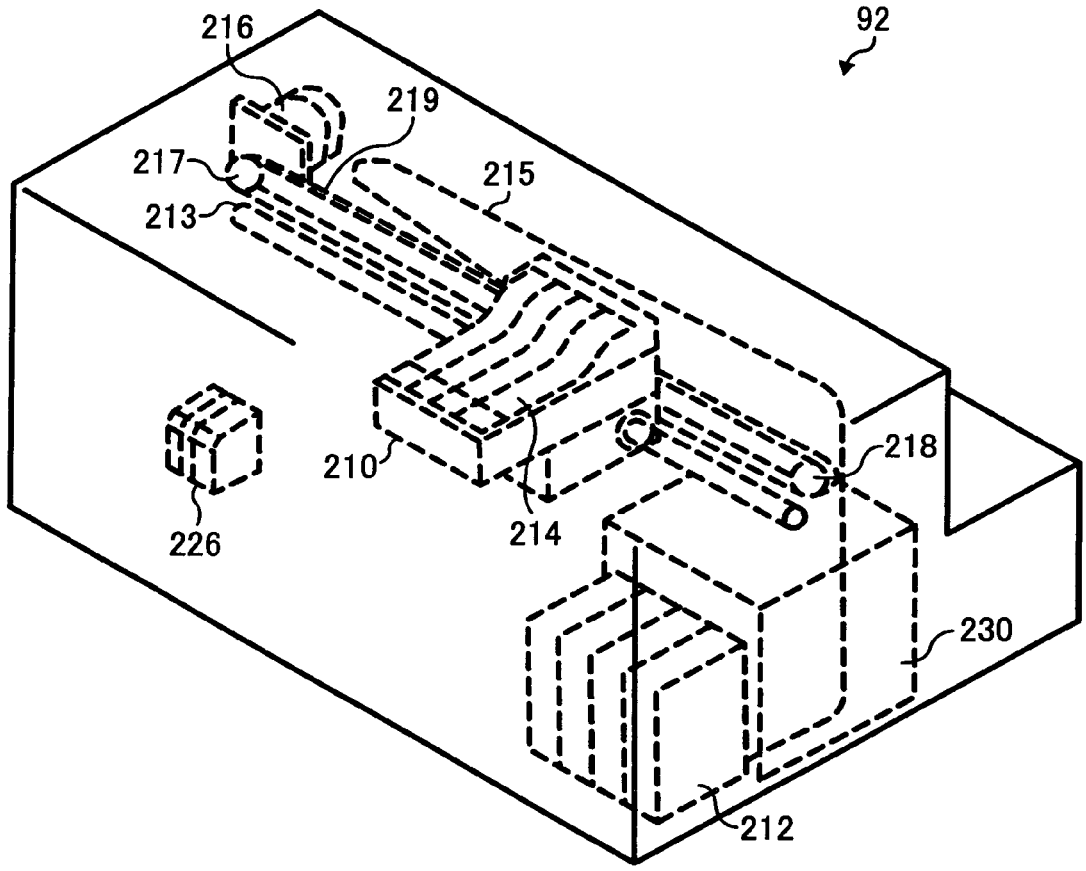
FIG. 10 is a perspective view of an image forming unit of the image forming apparatus shown in FIG. 9.

As illustrated in FIG. 10, the image forming unit 92 further includes ink cartridges 212, a guide rod 213, sub tanks 214, a tube 215, a main scanning motor 216, a timing belt 219, a driving pulley 217, a driven pulley 218, a maintenance-recovery mechanism 230, and a sub-scanning motor 226.

The ink cartridges 212 are attachable to and detachable from the image forming unit 92 for replacement and contain ink in the yellow, magenta, cyan, and black colors to be supplied to the recording heads 211 shown in FIG. 9 via the sub tanks 214. The guide rod 213 is laterally bridged between both side boards (not shown) in the main scanning direction and supports the carriage 210 in a manner that the carriage 210 may slide in the main scanning direction. The guide rod 213 functions as a guide member for guiding the carriage 210. The carriage 210 carries the recording heads 211 in a manner that the recording heads 211 discharge in drops in the yellow, magenta, cyan, and black colors downward. The sub tanks 214 are disposed on the carriage 210 and supply ink in the yellow, magenta, cyan, and black colors to the recording heads 211. The tube 215 connects the ink cartridges 212 to the sub tanks 214 so that ink is supplied from the ink cartridges 212 to the sub tanks 214. The main scanning motor 216 rotates the driving pulley 217. The timing belt 219 is looped over the driving pulley 217 and the driven pulley 218. The driving pulley 217 rotates the timing belt 219. The driven pulley 218 is driven by the rotating timing belt 219 to rotate. The carriage 210 slides on the guide rod 213. To move the carriage 210 in the main scanning direction, the timing belt 219 is fixed to the carriage 210. The maintenance-recovery mechanism 230 is disposed in an end portion in a moving direction of the carriage 210 and maintains and recovers reliability of the recording heads 211. While the recording heads 211 do not perform printing, the recording heads 211 are positioned in the maintenance-recovery mechanism 230 in which caps (not shown) cap the recording heads 211. The sub-scanning motor 220 rotates the driving roller 223 shown in FIG. 19 via gears (not shown).

According to this non-limiting embodiment, the recording heads 211 are independently provided respectively for the yellow, magenta, cyan, and black colors. However one recording head 211 may include a nozzle for discharging ink drops in the yellow, magenta, cyan, and black colors. The recording heads 211 include recording heads of piezo, bubble, and electrostatic types. In the piezo type recording head, pressure is applied to ink via a vibration board forming a wall of a discharging room (i.e., an ink flow route) and including an electromechanical sensing element such as a piezoelectric device. In the bubble type recording head, pressure is applied to ink by a bubble generated through film boiling performed by a heat generating resistance body. In the electrostatic type recording head, pressure is applied to ink by deforming a vibration board forming a wall of an ink flow route with an electrostatic force generated between the vibration board and an electrode opposing the vibration board.

According to this non-limiting embodiment, the electrostatic type recording head is used.

As illustrated in FIG. 9, the image forming apparatus 102 further includes a conveyance belt unit 240. The conveyance belt unit 240 includes the conveyance belt 227, the driving roller 223, rollers 231 and 232, and a cover 242.

The conveyance belt unit 240 functions as a belt unit which is attachable to and detachable from the image forming apparatus 102. The driving roller 223 and the rollers 231 and 232 form rotating supports over which the conveyance belt 227 is looped. The cover 242 covers a portion on the outer circumferential surface of the conveyance belt 227.

The conveyance belt unit 240 may be inserted into and removed from the image forming apparatus 102 in a direction which is substantially horizontal and perpendicular to the sheet conveyance direction. The conveyance belt unit 240 has a basic structure similar to that of the conveyance belt unit 140 of the image forming apparatus 103, according to the previous embodiment. The carriage 210 is disposed above the conveyance belt 227 in the, vertical direction. If the cover 242 is disposed to cover a portion on the outer circumferential surface of the conveyance belt 227 which faces upward in the vertical direction when the conveyance belt knit 240 is installed in the image forming apparatus 102 like the covers 42 and 43 of the image forming apparatus 100, a mechanism for moving the cover 242 to a position where the cover 242 may not disturb proper operations of mechanisms surrounding the conveyance belt 227 is required when the conveyance belt unit 240 is installed in the image forming apparatus 102, resulting in a complex structure of the conveyance belt unit 240. Therefore, the cover 242 is disposed to cover a portion on the outer circumferential surface of the conveyance belt 227 which faces downward in the vertical direction when the conveyance bet unit 240 is installed in the image forming apparatus 102. The conveyance belt unit 240 further includes guided members (not shown) disposed on an outer surface of the cover 242 and configured like the guided members 145 and 146 of the image forming apparatus 101 according t the previous embodiment. The image forming apparatus 102 further includes guide rails (not shown) which engage with the guided members when the conveyance belt unit 240 is inserted into or removed from the image forming apparatus 102. The guide rails are configured like the guided rails 131 and 132 of the image forming apparatus 101 according to the previous embodiment, and function as guide members for guiding the conveyance belt unit 240 when the conveyance belt unit 240 is inserted into or removed from the image forming apparatus 102.

As described above, the intermediate transfer unit 40, the conveyance belt unit 140, and the conveyance belt unit 240 respectively include the intermediate transfer belt 10, the conveyance belt 110, and the conveyance belt 227. Each of the intermediate transfer belt 10, the conveyance belt 110, and the conveyance belt 227 is formed in an endless belt shape and is looped over at least two rotating supports. Each of the intermediate transfer unit 40, the conveyance belt unit 140, and the conveyance belt unit 240 further includes the supporting frames 41 which rotatably support the rotating supports, and is inserted into and removed from each of the image forming apparatuses 100, 101, and 102 in a substantially horizontal direction. The intermediate transfer unit 40, the conveyance belt unit 140, and the conveyance belt unit 240 respectively include the covers 42 and 43, the covers 142 and 143, and the cover 242 as well as the guided members 45 and 46 and the guided members 145 and 146. The covers 42 and 43, the covers 142 and 143, and the cover 242 respectively cover the outer circumferential surfaces of the intermediate transfer belt 10, the conveyance belt 110, and the conveyance belt 227. The guided members 45 and 46 and the guided members 145 and 146 respectively engage with the guide rails 31 and 32 and the guide rails 131 and 132 disposed in the image forming apparatuses 100, 101, and 102 when the intermediate transfer unit 40, the conveyance belt unit 140, and the conveyance belt unit 240 are respectively inserted into or removed from the image forming apparatuses 100, 101, and 102. The guided members 45 and 46 and the guided members 145 and 146 are respectively disposed on the outer surfaces of the covers 42 and 43, the covers 142 and 143, and the covet 242. The intermediate transfer unit 40, the conveyance belt unit 140, and the conveyance belt unit 240 may be respectively inserted into and removed from the image forming apparatuses 100, 101, and 102 in a state that the guided members 45 and 46 and the guided members 145 and 146 are respectively engaged with the guide rails 31 and 32 and the guide rails 131 and 132 at any angle if a direction formed by the angle is parallel to the outer surface of each of the covers 42 and 43, the covers 142 and 143, and the cover 242. Namely, the direction in which each of the intermediate transfer unit 40, the conveyance belt unit 140, and the conveyance belt unit 240 is inserted into and removed from each of the image forming apparatuses 100, 101, and 102 may not be limited to a direction perpendicular to the direction of the shafts of the rotating supports.

In the image forming apparatus 100, the covers 42 and 43 cover the outer circumferential surface of the intermediate transfer belt 10 which faces upward in the vertical direction when the intermediate transfer unit 40 is installed in the image forming apparatus 100. Thus, the covers 42 and 43 may prevent unnecessary substances falling toward the outer circumferential surface of the intermediate transfer belt 10 from adhering onto the outer circumferential surface of the intermediate transfer belt 10 and thereby creating an image of decreased quality.

In the image forming apparatus 100, the guided members 45 and 46 are respectively disposed on the outer end portions of the covers 42 and 43. The cover 44 shields portions on the outer circumferential surface of the intermediate transfer belt 10 under the guided members 45 and 46. Thus, powders generated by the guided members 45 and 46 sliding on the guide rails 31 and 32 may not fall onto the outer circumferential surface of the intermediate transfer belt 10, preventing the powders from producing an image of decreased quality.

In the image forming apparatuses 101 and 102, at least part of each of the covers 142, 143, and 242 covers the outer circumferential surface of each of the conveyance belts 110 and 227 which faces downward in the vertical direction when each of the conveyance belt units 140 and 240 is installed in each of the image forming apparatuses 101 and 102. Thus, the covers 142 and 143 and the cover 242 may respectively prevent unnecessary substances scattered inside and outside the image forming apparatuses 101 and 102 from adhering onto the outer circumferential surfaces of the conveyance belts 110 and 227, preventing the substances from producing an image of decreased quality.

In the image forming apparatus 100, 101, or 102, the end portions 45*a* and 46*a* are respectively disposed on ends of the guided members 45 and 46 or the guided members 145 and 146 facing the image forming apparatus 100, 101, or 102 when the intermediate transfer unit 40, the conveyance belt unit 140, or the conveyance belt unit 240 is inserted into the image forming apparatus 100, 101, or 102, and protrude from the outer surface of the supporting frame 41 facing the image forming apparatus 100, 101, or 102 when the intermediate transfer unit 40, the conveyance belt unit 140, or the conveyance belt unit 240 is inserted into or removed from the image forming apparatus 100, 101, or 102. Thus, the guided members 45 and 46 and the guided members 145 and 146 may easily engage with the guide rails 31 and 32 and the guide rails 131 and 132 respectively.

The end portions 45*a* and 46*a* of the guided members 45 and 46 or the guided members 145 and 146 which face the image forming apparatus 100, 101, or 102 when the intermediate transfer unit 40, the conveyance belt unit 140, or the conveyance belt unit 240 is inserted into or removed from the image forming apparatus 100, 101, or 102 may include the markings. The markings may cause the operator of the image forming apparatus 100, 101, or 102 to easily identify the end portions 45*a* and 46*a* to be engaged with the guide rails 31 and 32 or the guide rails 131 and 132, thereby providing easy engaging operation for the operator and reducing errors made by the operator during the engaging operation.

In the image forming apparatuses 100, 101, and 102, the covers 42 and 43, the covers 142 and 143, and the cover 242 include the resin. Thus, the covers 42, 43, 142, 143, and 242 may be easily molded, resulting in a decrease in manufacturing costs and a decreased weight of each of the intermediate transfer unit 40, the conveyance belt unit 140, and the conveyance belt unit 240.

In the image forming apparatuses 100, 101, and 102, the guided members 45 and 46 and the guided members 145 and 146 are integrally molded with the covers 42 and 43, the covers 142 and 143, and the cover 242 respectively, resulting in a simple production process.

In the image forming apparatus 100, 101, or 102, the stays 47 and 48 include a material having a rigidity greater than that of the cover 42, 43, 142, 143, or 242, and function as the deformation preventing members for preventing an external force applied to the guided members 45 and 46 or the guided members 145 and 146 from deforming the covers 42 and 43, the covers 142 and 143, or the cover 242. The stays 47 and 48 are disposed near the guided members 45 and 46 or the guided members 145 and 146. Thus even when the cover 42, 43, 142, 143, or 242 has a decreased rigidity, the weight of the intermediate transfer unit 40, the conveyance belt unit 140, or the conveyance belt unit 240 may not deform, the covers 42 and 43, the covers 142 and 143, or the cover 242 via the guided members 45 and 46 or the guided members 145 and 146.

In the image forming apparatus 100, the handles 49 and 50 used by the operator of the image forming apparatus 100 to carry the intermediate transfer unit 40 are respectively disposed on the stays 47 and 48. Thus, the covers 42 and 43 may not be deformed while the operator carries the intermediate transfer unit 40 by using the handles 49 and 50.

In the image forming apparatus 100, 101, or 102, the intermediate transfer unit 40, the conveyance belt unit 140, or the conveyance belt unit 240 includes a plurality of the guided members. Thus, the force respectively applied on the covers 42 and 43, the covers 142 and 143, or the cover 242 by the weight of the intermediate transfer unit 40, the conveyance belt unit 140, or the conveyance belt unit 240 via the guided members 45 and 46 or the guided members 145 and 146 may be dispersed to decrease a rigidity of portions on which the guided members 45 and 46 or the guided members 145 and 146 are disposed.

In the image forming apparatus 100, the intermediate transfer belt 10 functions as an image carrier for carrying a toner image on its outer circumferential surface. The direction in which the intermediate transfer unit 40 is inserted into and removed from the image forming apparatus 100 may not be limited to a direction perpendicular to the direction of the shafts of the rotating supports.

In the image forming apparatus 101 or 102, the conveyance belt 110 or 227 functions as a sheet conveyer for carrying and conveying a recording sheet 29 or 202 on its outer circumferential surface. The direction in which the conveyance belt unit 140 or 240 is inserted into or removed from the image forming apparatus 101 or 102 may not be limited to a direction perpendicular to the direction of the shafts of the rotating supports.

In the image forming apparatuses 100, 101, and 102, the guide rails 31 and 32 and the guide rails 131 and 132 respectively support the intermediate transfer unit 40 and the conveyance belt units 140 and 240 via the guided members 45 and 46 and the guided members 145 and 146 when the intermediate transfer unit 40, the conveyance belt unit 140, and the conveyance belt unit 240 are respectively inserted into or removed from the image forming apparatuses 100, 101, and 102. Thus, no extra element may be required to support the intermediate transfer unit 40, the conveyance belt unit 140, or the conveyance belt unit 240 when the intermediate transfer unit 40, the conveyance belt unit 140, or the conveyance belt unit 240 is inserted into or removed from the image forming apparatuses 100, 101, or 102.

In the image forming apparatus 100, 101, or 102, the guide rails 31 and 32 or the guide rails 131 and 132 extend in a direction parallel to the direction of the shafts of the rotating supports of the intermediate transfer unit 40, the conveyance belt unit 140, or the conveyance belt unit 240. Thus, the intermediate transfer unit 40, the conveyance belt unit 140, or the conveyance belt unit 240 may be inserted into and removed from the image forming apparatus 100, 101, or 102 in the direction of the shafts of the rotating supports.

However, the guide rails 31 and 32 or the guide rails 131 and 132 may extend in a direction perpendicular to the direction of the shafts of the rotating supports of the intermediate transfer unit 40, the conveyance belt unit 140, or the conveyance belt unit 240. In this case, the intermediate transfer unit 40, the conveyance belt unit 140, or the conveyance belt unit 240 may be inserted into and removed from the image forming apparatus 100, 101, or 102 in the direction perpendicular to the direction of the shafts of the rotating supports.

The image forming apparatuses 100 and 101 include the tandem type image forming apparatus in which the four photoconductors 1Y, 1M, 1C, and 1K are disposed on the common horizontal plane. However, the present invention is applicable to the tandem type image forming apparatus in which the four photoconductors 1Y, 1M, 1C, and 1K are arranged along a direction which is oblique with respect to the horizontal plane while the shafts of the photoconductors 1Y, 1M, 1C, and 1K extend parallel to each other.

The present invention is applicable to not only the tandem type image forming apparatus but also any type image forming apparatus as long as the belt unit including an endless belt may be inserted into and removed from the image forming apparatus in the substantially horizontal direction.

The present invention has been described above with reference to specific embodiments. Note that the present invention is not limited to the details of the embodiments described above, but various modifications and improvements are possible without departing from the spirit and scope of the invention. It is therefore to be understood that within the scope of the appended claims, the present invention maybe practiced otherwise than as specifically described herein. For example, elements and/or features of different illustrative embodiments may be combined with each other and/or substituted for each other within the scope of the present invention and appended claims.

What is claimed is:

1. An image forming apparatus, comprising:

an image forming mechanism configured to form an image;

at least one guide member arranged in parallel; and a belt unit configured to be inserted into and removed from the image forming apparatus along a lengthwise direction of the at least one guide member, the belt unit including, a belt formed in an endless belt shape and configured to transfer the image formed by the image forming mechanism, at least two rotating supports over which the belt is looped, a supporting frame configured to rotatably support the at least two rotating supports, a cover configured to cover an outer circumferential surface of the belt, at least one guided member disposed at positions in parallel on an outer surface of the cover and configured to engage with the at least one guide member and to be slidably moved along the at least one guide member when the belt unit is inserted into and removed from the image forming apparatus, wherein the cover covers a portion on the outer circumferential surface of the belt which faces upwardly in a vertical direction when the belt unit is installed in the image forming apparatus; and a shield configured to shield a portion on the outer circumferential surface of the belt under the at least one guided member and which is disposed on an end portion of the outer surface of the cover.

2. The image forming apparatus according to claim 1, wherein the belt unit is configured to be inserted into and removed from the image forming apparatus in a substantially horizontal direction.

3. The image forming apparatus according to claim 1, wherein at least part of the cover covers a portion on the outer circumferential surface of the belt which faces downward in a vertical direction when the belt unit is installed in the image forming apparatus.

4. The image forming apparatus according to claim 1, wherein the cover includes a resin.

5. The image forming apparatus according to claim 4, wherein the at least one guided member is integrally molded with the cover.

6. The image forming apparatus according to claim 4, further comprising:

a deformation preventing member disposed near the at least one guided member on the cover and including a material having a greater rigidity than the cover to prevent the cover from being deformed by a force applied to the at least one guided member.

7. The image forming apparatus according to claim 6, further comprising:

a handle disposed on the deformation preventing member and used by an operator of the image forming apparatus to carry the belt unit.

8. The image forming apparatus according to claim 1, wherein the belt includes any one of an image carrier configured to carry an image on the outer circumferential surface of the belt and a sheet conveyer configured to carry and convey a sheet on the outer circumferential surface of the belt.

9. The image forming apparatus according to claim 8, wherein the image forming mechanism forms an image on any one of the image carrier and the sheet on the sheet conveyer.

10. The image forming apparatus according to claim 9, wherein the image forming mechanism includes a plurality of latent image carriers arranged in line along the outer circumferential surface of any one of the image carrier and the sheet conveyer, and is configured to superimpose and transfer images formed on the latent image carriers onto any one of the outer circumferential surface of the image carrier and the sheet on the outer circumferential surface of the sheet conveyer.

11. The image forming apparatus according to claim 9, wherein the at least one guide member supports the belt unit via the at least one guided member when the belt unit is inserted into and removed from the image forming apparatus.

12. The image forming apparatus according to claim 9, wherein the at least one guide member extends in a direction parallel to a direction of shafts of the at least two rotating supports.

13. The image forming apparatus according to claim 9, wherein the at least one guide member extends in a direction perpendicular to a direction of shafts of the at least two rotating supports.

14. An image forming apparatus, comprising:

an image forming mechanism configured to form an image;

at least one guide member arranged in parallel; and a belt unit configured to be inserted into and removed from the image forming apparatus along a lengthwise direction of the at least one guide member, the belt unit including, a belt formed in an endless belt shape and configured to transfer the image formed by the image forming mechanism, at least two rotating supports over which the belt is looped, a supporting frame configured to rotatably support the at least two rotating supports, a cover configured to cover an outer circumferential surface of the belt, and at least one guided member disposed at positions in parallel on an outer surface of the cover and configured to engage with the at least one guide member and to be slidably moved along the at least one guide member when the belt unit is inserted into and removed from the image forming apparatus, wherein an end portion of the at least one guided member protrudes from an outer surface of the supporting frame which faces the image forming apparatus when the belt unit is inserted into the image forming apparatus.

15. The image forming apparatus according to claim 14, wherein the end portion of the at least one guided member includes a marking.

16. An image forming apparatus, comprising:

means for forming an image;

at least one means for being arranged in parallel; and means for being inserted into and removed from the image forming apparatus along a lengthwise direction of the at least one means for being arranged, the means for being inserted including, means for transferring the image formed by the means for forming and being formed in an endless belt shape, at least two means for supporting the means for transferring, means for rotatably supporting the at least two means for supporting the means for transferring, means for covering an outer circumferential surface of the means for transferring, and at least one means for engaging with the at least one means for being arranged, and being slidably moved along the at least one means for being arranged when the means for being inserted is inserted into and removed from the image forming apparatus, the at least one means for engaging being disposed at positions in parallel on an outer surface of the means for covering, wherein the means for covering covers a portion on the outer circumferential surface of the means for transferring which faces upwardly in a vertical direction when the means for being inserted is installed in the image forming apparatus: and shield means for shielding a portion on the outer circumferential surface of the means for transferring under the at least one means for engaging and which is disposed on an end portion of the outer surface of the means for covering.

17. A belt unit to be inserted into and removed from an image forming apparatus, comprising:

a belt formed in an endless belt shape;

at least two rotating supports over which the belt is looped;

a supporting frame configured to rotatably support the at least two rotating supports;

a cover configured to cover an outer circumferential surface of the belt; and at least one guided member disposed at positions in parallel on an outer surface of the cover and configured to engage with at least one guide member provided in the image forming apparatus and to be slidably moved along the at least one guide member when the belt unit is inserted into and removed from the image forming apparatus;

wherein the cover covers a portion on the outer circumferential surface of the belt which faces upwardly in a vertical direction when the belt unit is installed in the image forming apparatus; and a shield configured to shield a portion on the outer circumferential surface of the belt under the at least one guided member and which is disposed on an end portion of the outer surface of the cover.

* * * * *